US006012861A

United States Patent [19]

Makino

[11] Patent Number: 6,012,861

[45] Date of Patent: Jan. 11, 2000

[54] CHARACTER WHEEL AND METHOD OF MANUFACTURING SAME, AND CHARACTER WHEEL BAND AND RING USABLE FOR CHARACTER WHEEL AND METHOD OF MANUFACTURING SAME

[76] Inventor: Kazunosuke Makino, 9-8-406, Yonban-Cho, Chiyoda-Ku, Tokyo, Japan

[21] Appl. No.: 08/995,842

[22] Filed: Dec. 22, 1997

[30] Foreign Application Priority Data

Dec. 24, 1996 [JP] Japan ..... 8-344084
Dec. 24, 1996 [JP] Japan ..... 8-344085

[51] Int. Cl.[7] ..... B41J 1/56; B41J 1/60

[52] U.S. Cl. ..... 400/175; 101/110

[58] Field of Search ..... 400/175; 101/109, 101/110, 111, 375, 378

[56] References Cited

U.S. PATENT DOCUMENTS

| | | | |
|---|---|---|---|
| 3,542,620 | 11/1970 | Dedek | 101/110 |
| 4,004,506 | 1/1977 | McInerny | 101/110 |
| 4,013,005 | 3/1977 | Keefe . | |
| 4,055,118 | 10/1977 | Sato | 101/110 |
| 4,119,030 | 10/1978 | Funahashi . | |
| 4,323,010 | 4/1982 | Hamisch, Jr. . | |
| 4,357,868 | 11/1982 | Pabodie . | |
| 4,457,230 | 7/1984 | Kurihara et al. | 101/110 |
| 4,843,960 | 7/1989 | Ernst et al. | 101/111 |

FOREIGN PATENT DOCUMENTS

| | | | |
|---|---|---|---|
| 0 149 515 | 7/1985 | European Pat. Off. . | |
| 0 718 112 | 6/1996 | European Pat. Off. . | |
| 850530 | 7/1949 | Germany | 101/110 |
| 674563 | 6/1952 | United Kingdom . | |
| 667409 | 8/1952 | United Kingdom . | |

*Primary Examiner*—Eugene Eickholt
*Attorney, Agent, or Firm*—Oblon, Spivak, McClelland, Maier & Neustadt, P.C.

[57] ABSTRACT

A character wheel, particularly for a numbering machine, including a character wheel disc having a plurality of printing portion mounting surfaces formed at an interval from each other in a circumferential direction on an outer peripheral surface of the character wheel disc and an engaging groove formed to at least one of portions between the respective printing portion mounting surfaces and a flexible character wheel band mounted to the outer peripheral surface of the character wheel disc. The character wheel band is formed with engaging projections formed at both longitudinal ends thereof and the engaging projections are engaged with the engaging groove formed to the character wheel disc so that the flexible character wheel band is mounted to the character wheel disc therearound.

10 Claims, 27 Drawing Sheets

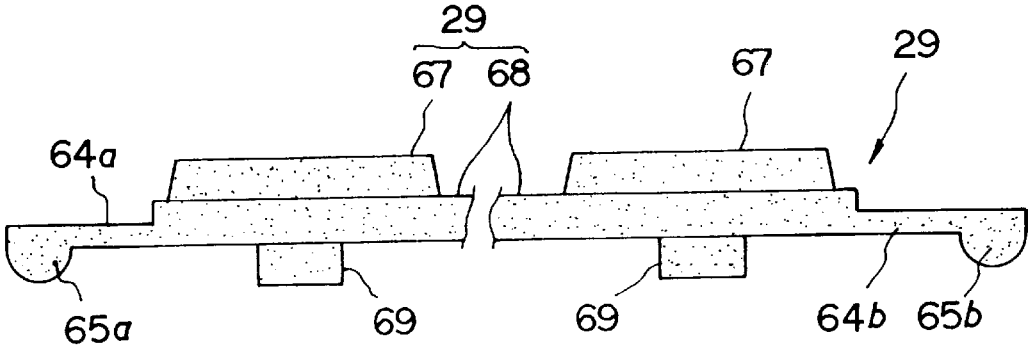
FIG. 12A1
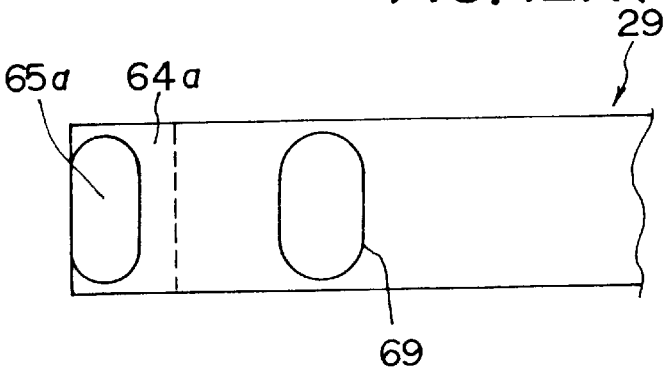
FIG. 12A2

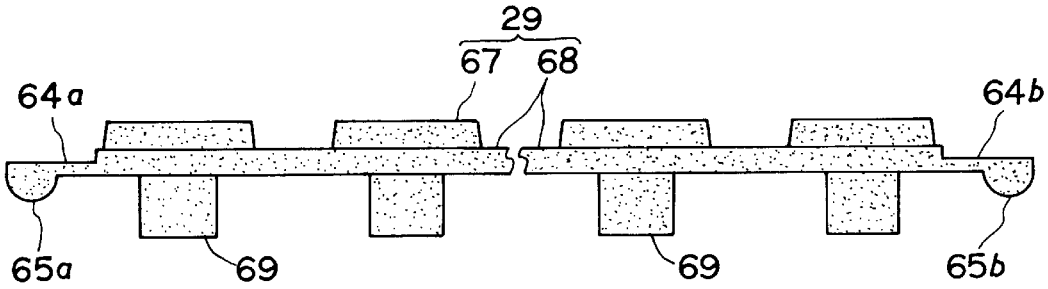
FIG. 12B1
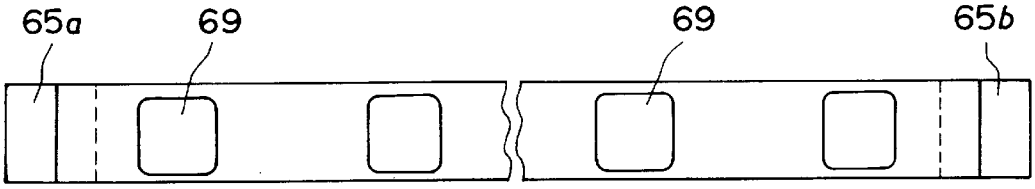
FIG. 12B2
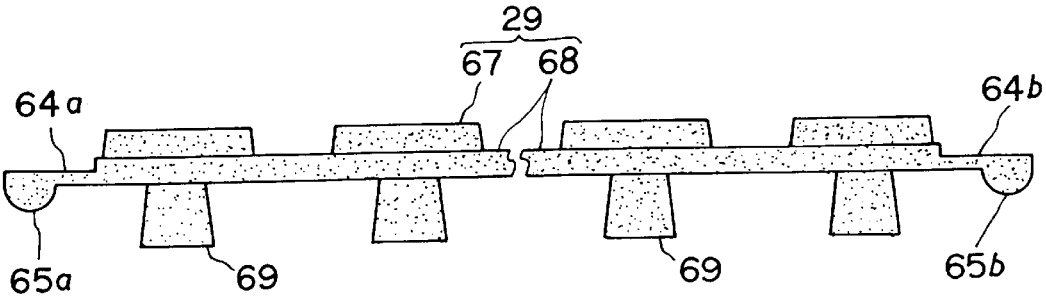
FIG. 12C1
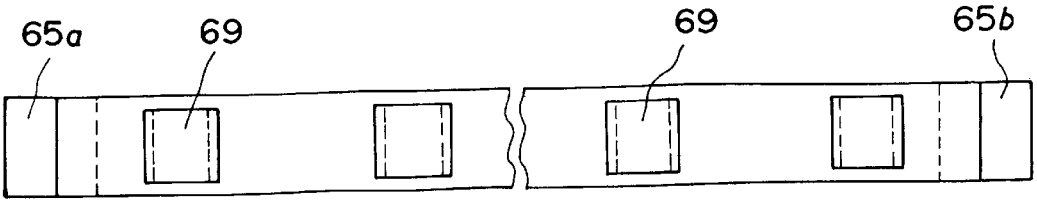
FIG. 12C2

CHARACTER WHEEL AND METHOD OF MANUFACTURING SAME, AND CHARACTER WHEEL BAND AND RING USABLE FOR CHARACTER WHEEL AND METHOD OF MANUFACTURING SAME

BACKGROUND OF THE INVENTION

The present invention relates to a character wheel used for a numbering machine, a data printing stamp, or other type of printing device and a method of manufacturing the same and also relates to a character wheel band or a character wheel ring usable for the character wheel and a method of manufacturing the same.

Numbering machines been extensively used as printing devices for numbering business documents or other documents to be printed. A conventional numbering machine includes a character wheel unit in a frame-shaped numbering main body such that it may move up and down. Desired printing element (portion) surfaces are selected from the character wheels of individual digits constituting the character wheel unit, and the surfaces of the selected printing portions are pressed against a document to number the same.

The character wheels of the respective digits constituting the character wheel unit are each formed by integrally molding the entire character wheels including the printing portions through a die casting process as disclosed in Japanese Utility Model Laid-open Publication No. SHO 62-15961, or by winding a flexible character wheel band around the outer periphery of a character wheel disc and fixing it by locking both ends of the flexible character wheel band in a locking groove provided in the space of a printing portion (element) mounting surface for one character formed on the outer peripheral surface of the character wheel disc as disclosed in Japanese Utility Model Laid-open Publication No. SHO 57-167869 or Japanese Utility Model Laid-open Publication No. SHO 58-69446.

In the former case where the character wheels of the respective digits constituting the character wheel unit are formed into one piece by the die casting, the one-piece molding formed through the die casting employs a metallic material such as aluminum, zinc, or iron, or a plastic material. The character wheels made of a metallic material or the like are plated with nickel, chromium, or the like which exhibits poor affinity for ink and high water repellency. This has been posing a problem in that ink is repelled or splashed, making it impossible to apply ink uniformly on a printing surface with a resultant blurred printed characters. Thus, uniformly printed sharp, clear characters have not been accomplished.

In the latter case where the flexible character wheel band is wound around the outer periphery of the character wheel disc and both ends thereof are fixed using the securing member, the locking groove is provided by utilizing the space for one character on the printing portion mounting surface of the outer peripheral surface of the character wheel disc, and the independent retaining member is used with the locking groove in order to fix both ends of the flexible character band. The locking groove, which occupies the space for one character, has been making it inappropriate for the numbering device adapted to print characters by successively rotating the character wheel band in turn.

Further, as the number of parts increases, it becomes difficult to maintain the accuracy of mounting the flexible character wheel band on the character wheel disc, so that it takes more time and effort to assemble the character wheel. In addition, since the flexible character wheel band is secured using the retaining member, the pitch of the printing blocks formed on the flexible character wheel band fails to be regular at the portion where the retaining member is attached, thus causing inconvenient variations in pitch. The flexible character wheel bands are formed by cutting the character wheel plate, which has been formed by vulcanizing, into narrow strips. It is difficult to insert a cutter between the flexible character wheel bands of the character wheel plate to accurately cut the flexible print bands with a precise width. Therefore, great care and effort have been required in cutting the character wheel plate, the cut flexible character wheel bands vary in width, and the variations are great, leading to such shortcomings as a low yield.

Moreover, the ends of the flexible character wheel bands are fixed by using the retaining members, making them impossible to be used as the character wheels for a numbering machine.

SUMMARY OF THE INVENTION

A primary object of the present invention is to substantially eliminate defects and drawbacks encountered in the prior art described above and to provide a character wheel and a method of manufacturing the same and to provide a character wheel band or ring usable for the character wheel and method of manufacturing the same having structures and characters capable of manufacturing a flexible character wheel unit easily and inexpensively with high accuracy and providing good affinity for ink so as to allow sharp and clear printing and of manufacturing a character wheel unit capable of forming a printing portion with uniform pitch interval along an entire peripheral surface thereof, easily and inexpensively with high accuracy.

Another object of the present invention is to provide a character wheel and its manufacturing method, and a character wheel band usable for the character wheel and its manufacturing method which makes it possible to easily provide rubber character wheel bands in which the pitches among the printing portions can be uniformly and accurately formed over the full peripheries thereof and which have uniform width, i.e. which are free of variations in width.

A further object of the present invention is to provide a character wheel for a numbering machine or the like, which character wheel permits numerals, etc. to be printed in sequence by winding a flexible character wheel band around a character wheel disc, and retaining the engaging projections of the flexible character wheel band, without using an independent retaining member, in an engaging groove provided in at least one space between adjoining printing portion (character) mounting surfaces on the outer peripheral surface of the character wheel disc and also to provide a manufacturing method for the flexible character wheel band.

A still further object of the present invention is to provide a character wheel band and its manufacturing method which allow flexible character wheel bands with uniform widths to be formed easily from a character wheel plate without using a mechanical cutting means such as a cutter.

A still further object of the present invention is to provide a character wheel and a method of manufacturing the same capable of continuously printing numerals, symbols, marks, etc. by connecting both the end connecting portions of a flexible rubber wheel band so as to provide an endless band-shape character wheel ring to the connection portion between adjacent processing surfaces of a polygonal character wheel disc.

A still further object of the present invention is to provide a character wheel ring and a method of manufacturing the same capable of manufacturing a flexible character wheel ring with a uniform width from a character wheel sleeve without using a mechanical cutting means such as a cutter.

These and other objects of the present invention can be achieved by providing, in one aspect, a character wheel comprising:

a character wheel disc having a plurality of printing portion mounting surfaces formed at an interval from each other in a circumferential direction on an outer peripheral surface of the character wheel disc and an engaging groove formed to at least one of portions between the respective printing portion mounting surfaces; and a flexible character wheel band mounted to the outer peripheral surface of the character wheel disc, the character wheel band having engaging projections formed at both longitudinal ends thereof, the engaging projections being engaged with the engaging groove formed to the character wheel disc so that the flexible character wheel band is mounted to the character wheel disc therearound.

In preferred embodiments, the character wheel disc further has guide grooves formed to the printing portion mounting surfaces, respectively, for positioning the character wheel band on the character wheel disc, and the character wheel band has engaging elements formed to a surface thereof on a side facing the character wheel disc so that the engaging elements are engaged with the guide grooves formed to the character wheel disc.

Each of the guide grooves has a rectangular, trapezoidal or like shape in section and each of the engaging elements has a rectangular, trapezoidal or like shape in section engageable with the guide groove.

The flexible character wheel band is formed of rubber and composed of printing portions on which numerals, letters, symbols or the like are formed and connection portions connecting the respective printing portions so as to provide an integral band shape.

The character wheel disc is formed with, at a central portion thereof, a shaft inserting hole through which a character wheel shaft is inserted and a feed ratchet plate is formed on a side surface of the character wheel disc in an integral manner.

In another aspect, there is provided a method of manufacturing a character wheel comprising the steps of:

preparing a character wheel disc, through a molding process, having a plurality of printing portion mounting surfaces formed at an interval from each other in a circumferential direction on an outer peripheral surface of the character wheel disc and an engaging groove formed to at least one of portions between the respective printing portion mounting surfaces, and also preparing, through a vulcanization process, a flexible character wheel band having engaging projections formed to both longitudinal ends thereof; and mounting the character wheel band to the character wheel disc such that the engaging projections formed at both longitudinal ends thereof are engaged with the engaging groove formed to the character wheel disc so that the flexible character wheel band is mounted to the character wheel disc.

The flexible character wheel band is formed of rubber material such as natural rubber or synthetic rubber.

The character wheel disc is formed so as to be further provided with guide grooves formed to the printing portion mounting surfaces, respectively, for positioning the character wheel band on the character wheel disc and the character wheel band is formed so as to be provided with engaging elements formed to a surface thereof on a side facing the character wheel disc so that the engaging elements are engaged with the guide grooves formed to the character wheel disc. The character wheel disc is formed with, at a central portion thereof, a shaft inserting hole through which a character wheel shaft is inserted and a feed ratchet plate is formed on a side surface of the character wheel disc in an integral manner.

In a further aspect, there is provided a character wheel band comprising:

a plurality of character wheel plates; and a weakened portion integrally formed to the character wheel plates in parallel to each other, the weakened portion being torn so as to form flexible character wheel bands.

The character wheel plates and the weakened portion are formed of an unvulcanized rubber sheet through a vulcanization process by means of a vulcanizing press.

In a still further aspect, there is provided a method of manufacturing a character wheel band comprising the steps of:

preparing an unvulcanized rubber sheet;

vulcanizing the unvulcanized rubber sheet in a mold by means of a vulcanizing press so as to form a character wheel plate; and removing an excessive portion at an outer peripheral portion of the character wheel plate and tearing the weakened portion so as to provide flexible character wheel bands.

In a still further aspect, there is provided a character wheel comprising:

a character wheel disc having a polygonal shape provided with a plurality of printing portion mounting surfaces formed at an interval from each other in a circumferential direction on an outer peripheral surface of the character wheel disc and connecting portions connecting adjacent printing portion mounting surfaces; and a flexible character wheel band mounted to the outer peripheral surface of the character wheel disc, the character wheel band having both longitudinal end portions to be bonded as a character wheel ring at one of the connecting portions of the character wheel disc.

In preferred embodiments, the character wheel disc further has guide portions formed to the printing portion mounting surfaces, respectively, for positioning the character wheel ring on the character wheel disc, and the character wheel band has both longitudinal ends to be bonded so as to provide an endless ring shape as a character wheel ring, the character wheel ring having engaging elements formed to a surface thereof on a side facing the character wheel disc so that the engaging elements are engaged with the guide portions formed to the character wheel disc. The guide portions of the character wheel disc are grooves and the engaging elements of the character wheel ring are projections. Each of the guide grooves has a rectangular, trapezoidal or like shape in section and each of said engaging elements has a rectangular, trapezoidal or like shape in section engageable with said guide groove.

The flexible character wheel band is formed of rubber and composed of printing portions on which numerals, letters, symbols or the like are formed and connection portions connecting the respective printing portions so as to provide an integral band shape. Both the ends of the character wheel band are cut in stage shapes which are engageable with each other so as to provide a flat joining portion when engaged. The character wheel disc is formed with, at a central portion thereof, a shaft inserting hole through which a character wheel shaft is inserted and a feed ratchet plate is formed on a side surface of the character wheel disc in an integral manner.

In a still further aspect, there is provided a method of manufacturing a character wheel comprising the steps of:

preparing a character wheel disc, through a molding process, having a positioning guide portion on an outer peripheral surface thereof and also preparing, through a vulcanization process, a flexible character wheel band having both longitudinal ends bonded to each other so as to provide an endless ring as a character wheel ring and having a positioning engaging portion; and mounting said character wheel ring to the character wheel disc such that the positioning engaging portion of the character wheel ring is engaged with the positioning guide portion of the character wheel disc.

The flexible character wheel band is formed of rubber material such as natural rubber or synthetic rubber.

The character disc is formed with, at a central portion thereof, a shaft inserting hole through which a character wheel shaft is inserted and a feed ratchet plate is formed on a side surface of the character wheel disc in an integral manner.

In a still further aspect, there is provided a character wheel ring comprising:

a plurality of character wheel bands; and a weakened portion integrally formed to the character wheel bands in parallel to each other to provide a character wheel plate, the character wheel plate being bonded at both longitudinal ends thereof so as to provide a character wheel sleeve and the weakened portion then being torn so as to form flexible character wheel rings each having an endless shape.

The character wheel bands and the weakened portion are formed of an unvulcanized rubber sheet through a vulcanization process by means of a vulcanizing press.

In a still further aspect, there is provided a method of manufacturing a character wheel band comprising the steps of:

preparing an unvulcanized rubber sheet;

vulcanizing the unvulcanized rubber sheet in a mold by means of a vulcanizing press so as to form a character wheel plate; and removing an excessive portion at an outer peripheral portion of the character wheel plate;

bonding both longitudinal ends of the character wheel plate so as to provide a character wheel sleeve; and tearing the weakened portion of the character wheel sleeve so as to provide flexible character wheel rings each having an endless ring shape.

According to the present invention of the characters and structures mentioned above, the character wheel band can be accurately positioned and easily mounted on the outer periphery of the character wheel disc and the character wheels can be manufactured inexpensively with high accuracy without using an independent engaging member simply by mounting the rubber flexible character wheel band on the outer periphery of the character wheel disc, and engaging the positioning engaging portions formed on the rear surfaces of the character wheel band with the positioning guide engaging portions formed on the outer peripheral surface of the character wheel disc and by engaging the engaging projections formed at both ends of the character wheel band in the engaging groove in the character wheel disc. The thus manufactured character wheel has fewer components. The number of manufacturing steps for the character wheel can be markedly reduced, and the manufacture of the character wheel can be made easier.

Further, the character wheel in accordance with the present invention allows numerals, symbols, etc. to be disposed on all sides of the outer periphery of the character wheel disc by engaging both ends of the character wheel band in the engaging groove provided in the connecting portion between adjoining printing portion mounting surfaces of the character wheel disc, thus making it possible to easily provide at low cost the character wheels suited for a numbering machine used for printing numerals, symbol, etc. in succession.

Furthermore, in the character wheel and the manufacturing method for the same in accordance with the present invention, the character wheel band mounted on the outer periphery of the character wheel disc is made of rubber, and therefore, the printing portions (elements) formed on the character wheel band present good affinity for ink, thus allowing ink to be uniformly applied to the printing portions so as to permit sharp and clear print.

Moreover, in the character wheel band and the manufacturing method for the same in accordance with the present invention, the rubber character wheel plate is formed by vulcanizing and forming an unvulcanized rubber sheet by means of the vulcanizing press, and the flexible character wheel bands are made by tearing them off by utilizing the weakened areas of the character wheel plate, and therefore, the character wheel bands can be manufactured without shredding the rubber character wheel plate by a cutter or other mechanical cutting means, thus permitting easy, inexpensive manufacture of character wheel bands. Since the discrete character wheel bands can be easily obtained by tearing them off of the character wheel plate at the weakened areas thereof, the widths of the character wheel bands are uniform and they maintain the equivalent accuracy to that of the molding accuracy of the vulcanizing press. They can be formed uniformly and accurately over the full lengths thereof.

In the above description, the advantageous functions and effects of the one aspect of the present invention relating to the character wheel provided with the character wheel band are mentioned. However, according to the present invention as mentioned above, there are also provided advantageous functions and effects obtainable by the character wheel ring which is formed by bonding both ends of the character wheel band and which is then mounted to the character wheel disc. Some of the advantageous functions and effects of this character wheel ring and the manufacturing method thereof are substantially the same as those mentioned above with reference to the character wheel band of the present invention, and other functions and effects will be made clear from the descriptions made herein with reference to the accompanying drawings.

BRIEF DESCRIPTION OF THE DRAWINGS

In the accompanying drawings:

FIG. 12A1 is a side, development view illustrative of the flexible character wheel band of FIGS. 9A and 10 and FIG. 12A2 illustrates one end section of the flexible character wheel band observed from the rear surface, and FIGS. 12B1, 12B2 and FIGS. 12C1, 12C2 represent the modifications of FIGS. 9B and 9C, respectively;

DESCRIPTION OF THE PREFERRED EMBODIMENTS

A character wheel and a method of manufacturing the same and a character wheel band used for the character wheel and a method of manufacturing the same according to the first embodiment of the present invention will be first described hereunder with reference to FIGS. 1 to 19 of the accompanying drawings.

Figure 1:
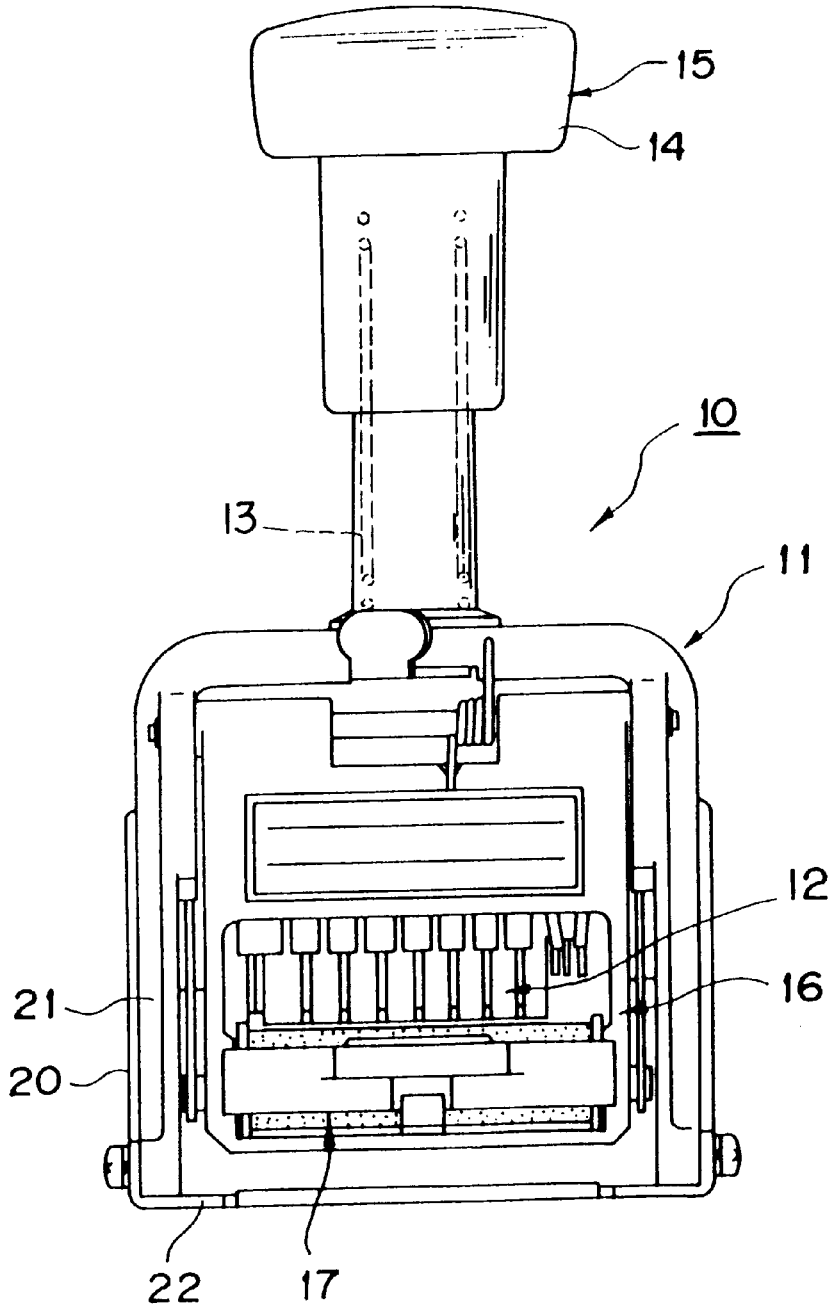
FIG. 1 is a front view illustrative of a numbering machine serving as a printing device equipped with a character wheel in accordance with the present invention.
Figure 2:
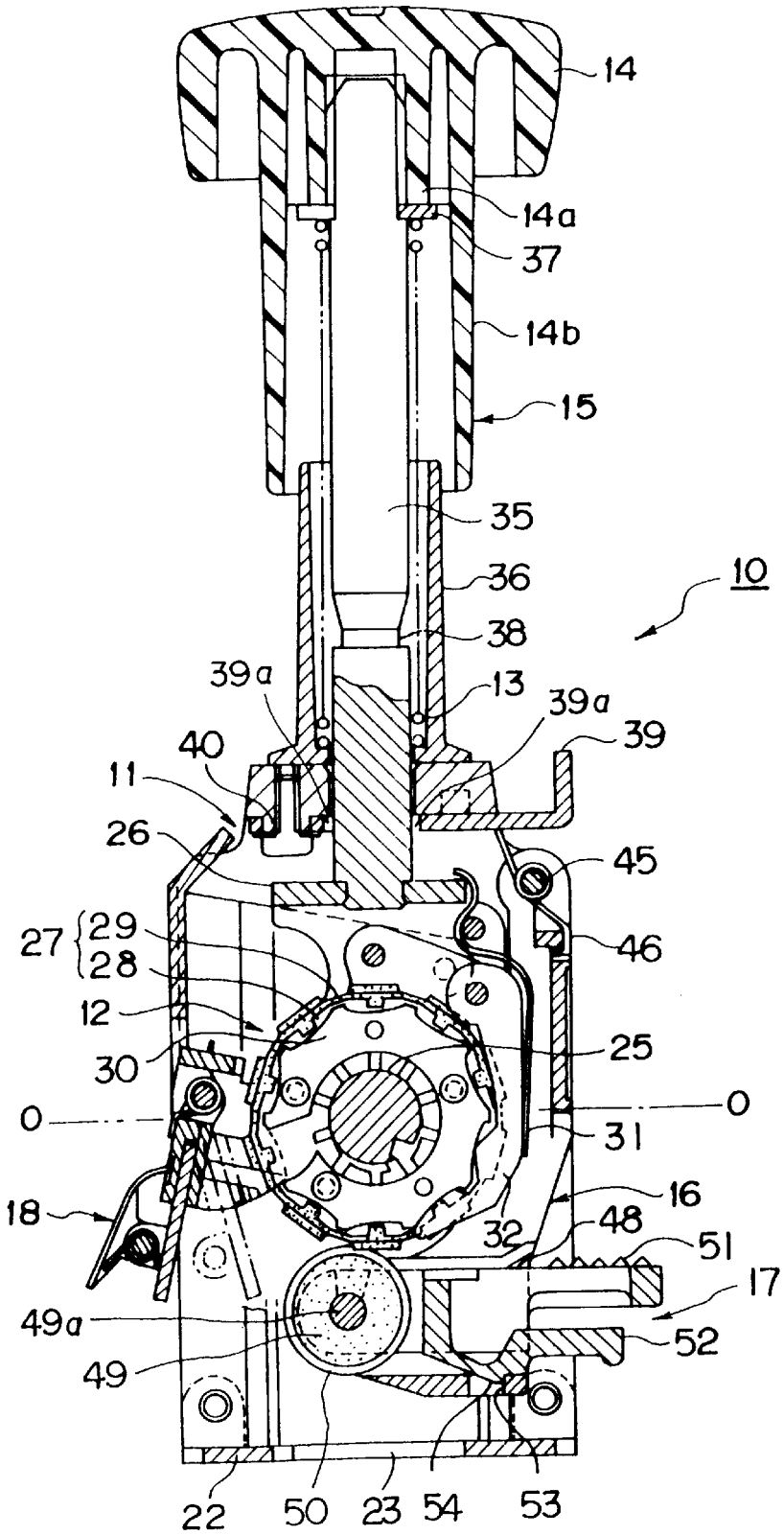
FIG. 2 is a longitudinal sectional view of the numbering machine shown in FIG. 1.

FIG. 1 and FIG. 2 are a front view and a longitudinal sectional view illustrating a numbering machine as a printing device equipped with a character wheel in accordance with the present invention. The numbering machine is a printing device for numbering business documents or other forms to be printed and the entire numbering machine is denoted by reference numeral 10. The numbering machine 10 for stamping seven-digit numbers is composed to measure, for example, about 67 wide, about 143 mm high, and about 40 mm deep. The numbering machine 10 may have eight digits or more.

The numbering machine 10 has a frame-shaped numbering main body 11, a character wheel device 12 mounted in the numbering main body 11 so as to be movable up and down between a printing position and its home position, a control means 15 provided with a control knob 14 for pressing the character wheel device 12 down against the spring force of a reset spring 13, a swing arm mechanism 16 which is adapted to swing as the control knob 14 is pressed, a cassette type ink roller device 17 detachably retained under the swing arm mechanism 16, and a printing number selecting device 18 for selecting the number of repetitive cycles of the same printing, i.e. the number of printing cycles (refer to FIG. 2).

The numbering main body 11 is constructed by assembling a gate-shaped frame 21 equipped with reinforcing side plates 20 and a bottom plate 22 secured to the bottom end of the gate-shaped frame 21 into one piece. A printing window 23 is formed in the bottom plate 22. The reinforcing side plates 20 of the numbering main body 11 have, on their opposing inner sides, lifting guide grooves (not shown) for guiding the character wheel device 12 when it goes up and down, and both ends of a character wheel shaft 25 of the character wheel device 12 are slidably fitted in the lifting guide groove so that the character wheel device is guided when it moves up and down. Although the reinforcing side plates 20 are fixed to the gate-shaped frame 21, these may be constituted by one-piece molding.

As shown in FIG. 2, the character wheel device 12 has a character wheel holder 26 configured like a gate-shaped frame, a character wheel shaft 25 supported by the character wheel holder 26, and a plurality of character wheels 27 which are rotatably mounted on the character wheel shaft 25 and which are combined side by side in the direction of the shaft axis. The character wheel 27 of each digit has a character wheel disc 28 supported by the character wheel shaft 25 which is inserted therethrough, and a rubber flexible character wheel band 29 attached to the outer periphery of the character wheel disc 28. A feed ratchet plate 30 is integrally fixed to a side surface of the character wheel disc 28 by a securing means such as a fixing pin. The feed ratchet plate 30 is engaged with a reverse rotation preventing member 32 shaped like a swing arm urged by a presser spring 31, and the reverse rotation preventing member 32 prevents the character wheels 27 from rotating in the reverse direction.

The character wheel device 12 is moved up and down by manually operating the control means 15. The control means 15 has a control shaft 35 fixed to the top of the character wheel holder 26 of the character wheel device 12, the control knob 14 screwed onto the top of the control shaft 35, and the reset spring 13 which urges the control knob 14 to an initial position, i.e., reset position. The bottom end of the control shaft 35 is secured to the character wheel holder 26. The control shaft 35 extends upward through a protective cylinder 36 provided at the top of the numbering main body 11 and the control knob 14 is screwed onto the top end of the shaft. The reset spring 13 is placed between the proximal end of the protective cylinder 36 and a spring shoe 37 mounted on the top of the control shaft 35, which constantly urges the control knob 14 to the reset position. The reset spring 13 is constantly covered by a protective sleeve 14*b* of the control knob 14 and the protective cylinder 36 so that it is prevented from being exposed outside.

Figure 3:
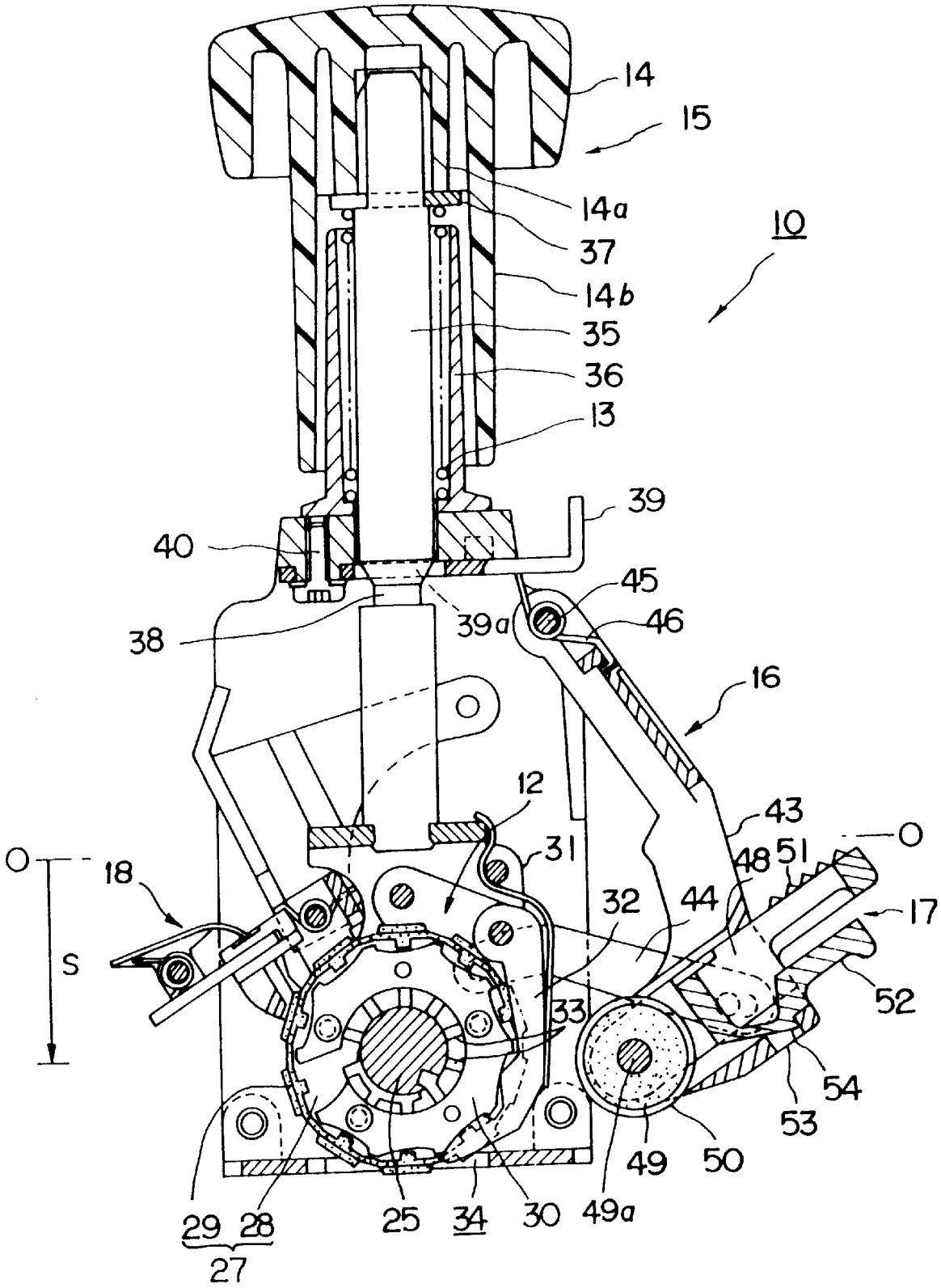
FIG. 3 is a longitudinal sectional view illustrative of the numbering machine shown in FIG. 1, which is in the process of printing.

Thus, When the control knob 14 is pushed down against the spring force of the reset spring 13, the character wheel device 12 integrally moves with the control knob 14 as the control knob is moved, and the character wheel device 12 moves down by a printing stroke S while being guided by the lifting guide groove, not shown, of the numbering main body 11 until it reaches the printing position as shown in FIG. 3. At this printing position, a desired printing surface of the character wheel device 12 is let pass through the printing window 23 and pressed to print a number. When the pressing operation through the control knob 14 is stopped, the character wheel device 12 is reset by the spring force of the reset spring 13 to the home position (initial position) shown in FIG. 3 from the printing position.

In the control means 15, the control shaft 35 has a narrowed section 38 at the middle thereof and the narrowed section 38 provides the control shaft 35 with a shoulder. A locking section 39*a* of a locking lever 39 engages with the shoulder. The locking lever 39 is rotatably supported around a vertical support shaft 40 at the top of the numbering main body 11 such that it moves circularly between a lock position and an unlock position.

When the control shaft 35 of the control means 15 is locked through the locking operation of the locking lever 39, the numbering machine 10 is locked with the swing arm mechanism 16 spread (FIG. 3) and held in the locked state.

The swing arm mechanism 16 is located before (in front of) the numbering main body 11 as illustrated in FIGS. 1 to 3. The swing am mechanism 16 has a swing arm 43 provided at the front top of the numbering main body 11 to be swingable, and a pair of coupling links 44 provided at the front both ends of the character wheel holder 26 of the character wheel device 12. The swing arm 43 is rotatably supported around a horizontal support shaft 45 provided at the front top of the numbering main body 11 and it is constantly urged clockwisely in the drawing by a tension spring 46.

As shown in FIG. 2 and FIG. 3, the swing arm 43 is formed such that it is shaped approximately like an inverted L shape when observed from the side as viewed and the bottom of the swing arm 43 is pin-connected to be slidable between itself and the free end of the coupling link 44 so as to impart a desired swinging stroke to the swing arm 43.

The cassette type ink roller device 17 is detachably retained under the swing arm mechanism 16. As shown in FIG. 2 and FIG. 3, the ink roller device 17 comprises a roller holding frame 48 of a frame body structure which can be attached to or detached from the swing arm mechanism 16 by one-touch simple operation, an ink roller 49 detachably supported by the roller holding frame 48 via an ink roller shaft 49*a* and side discs 50 attached to both sides of the ink roller 49. The side discs 50 have a larger diameter than the roller diameter of the ink roller 49, and the presence of the side discs 50 prevents the surroundings or the hands from being contaminated when attaching or detaching the ink roller 49.

In the roller holding frame 48, an operating handle 51 for installing or removing the ink roller device 17 and an elastic locking section 52 for retaining the ink roller device 17 in place project outward at the opposite side from the installing side of the ink roller 49. The operating handle 51 and the elastic locking section 52 are formed integrally with the roller holding frame 48 or they may be formed by one-piece molding. The elastic locking section 52 is equipped with a locking hook 54 retained in a locking hole 53 at the bottom of the swing arm 43 of the swing arm mechanism 16. The locking hook 54 engages with the locking hole 53 of the swing arm 43 to lock the ink roller device 17 and holds it in a stable manner, thus preventing from slipping out.

Figure 4:
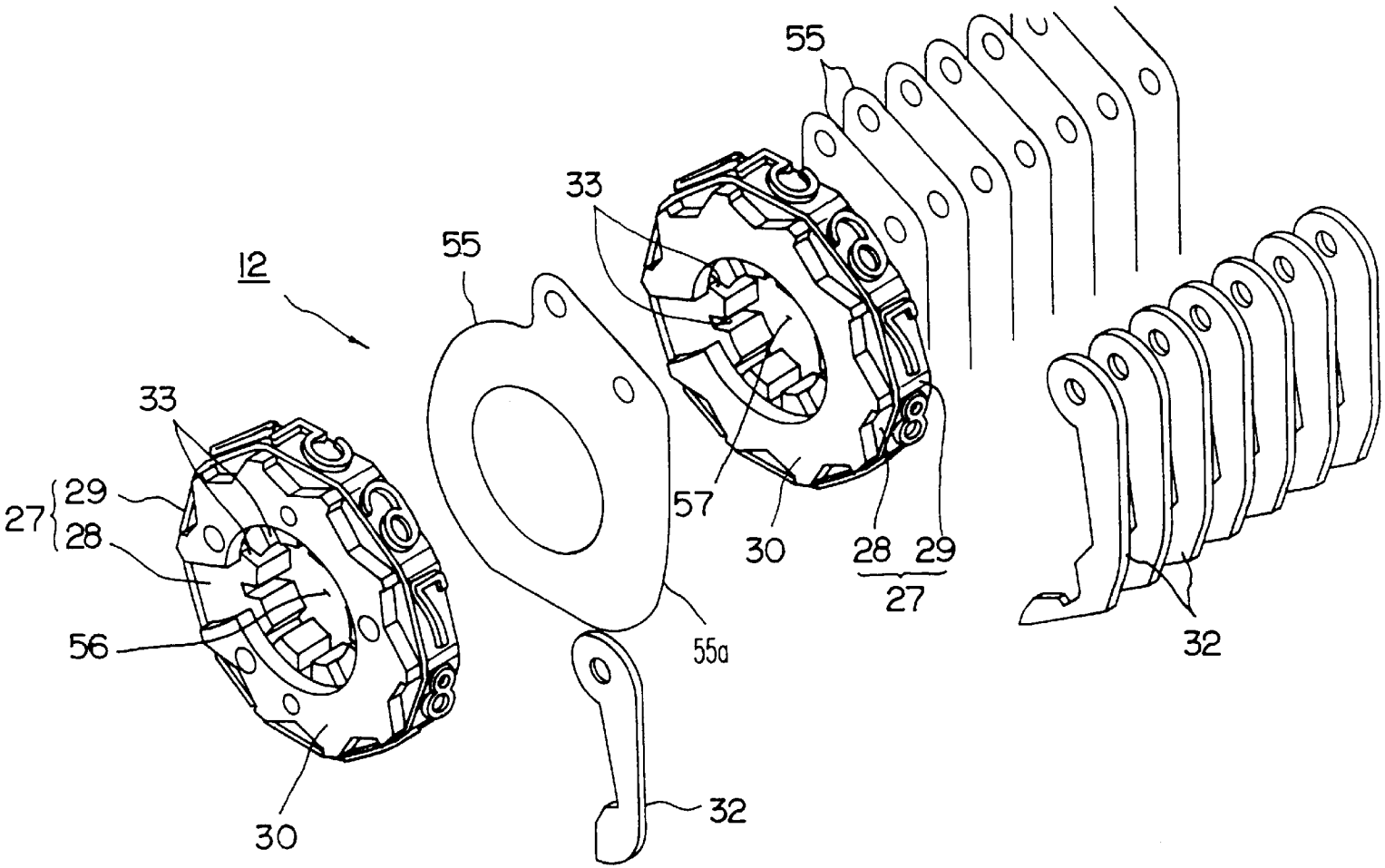
FIG. 4 is an exploded perspective view of the combined character wheels of individual digits making up the character wheel device for the numbering machine shown in FIG. 1.

The character wheel device 12 incorporated in the numbering machine 10 is constructed so that a numeral having a desired number of digits, e.g. seven digits, may be printed by combining the character wheels 27 of the respective digits in the axial direction of the character wheel shaft 25. As shown in FIG. 4, a spacer 55 of a thin metallic plate, ring, or washer type is placed between adjoining character wheels 27. When the spacer 55 is interposed between the character wheels 27 of the respective digits, the spacer 55 is formed with a swollen section 55*a* to an edge portion to be engaged with a reverse rotation preventing member 32 so as to prevent the reverse rotation preventing member 32 from riding on the edge portion of the spacer 55 and to maintain proper rotation preventing function. Further, a shaft inserting hole 56 of the character wheel 27 of the first digit out of the all digits is formed into an approximately perfect circle as a whole. Shaft inserting holes 57 of the character wheels 27 of the second digit and after are all formed to have the same configuration, and a swollen section 57*a* (see FIG. 5 and FIG. 7), which bulges locally outward in the radial direction, is provided as occasion demands when a particular digit or digits are not used, so that the character wheels 27 may be shifted in at a particular radial direction of the character wheel shaft 25.

Figure 5A:
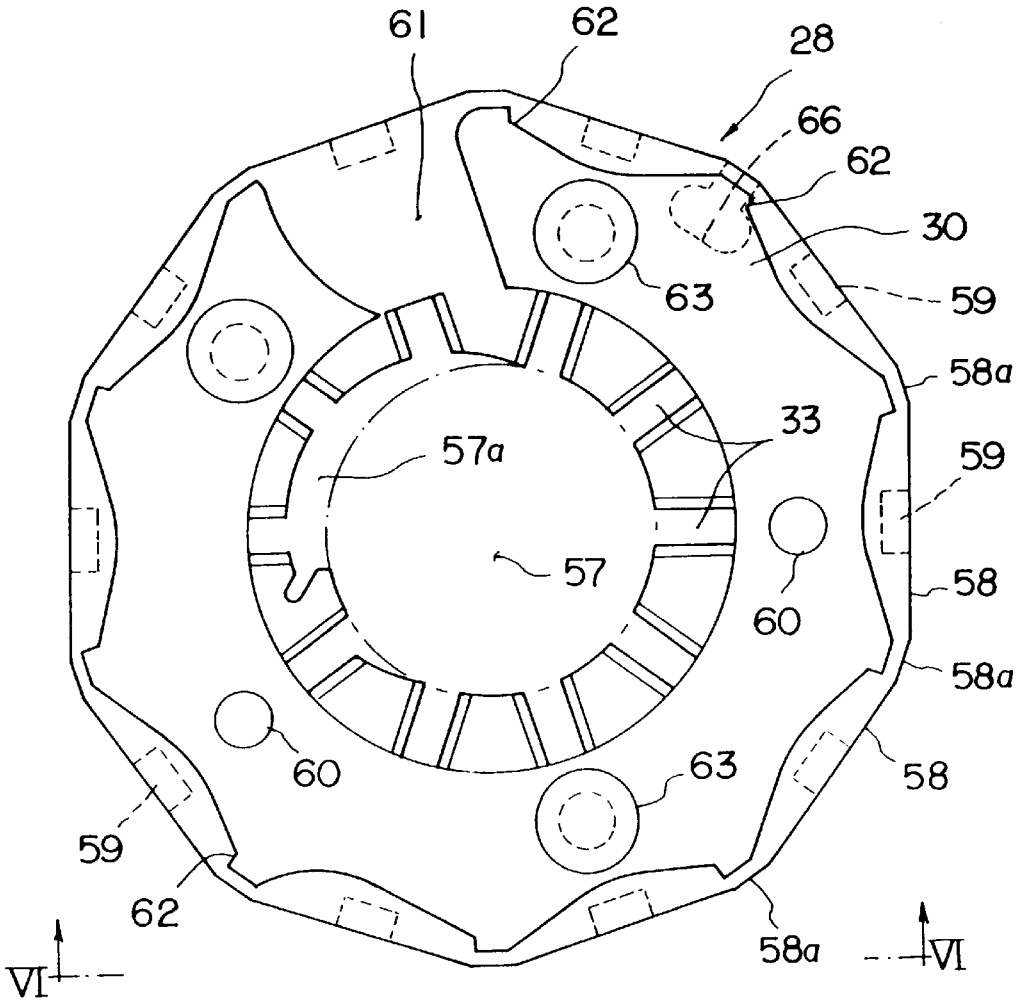
FIG. 5 is a front view illustrative of a character wheel disc constituting the character wheel representing a first embodiment (FIG. 5A) and a second embodiment (FIG. 5B) of the present invention.
Figure 5B:
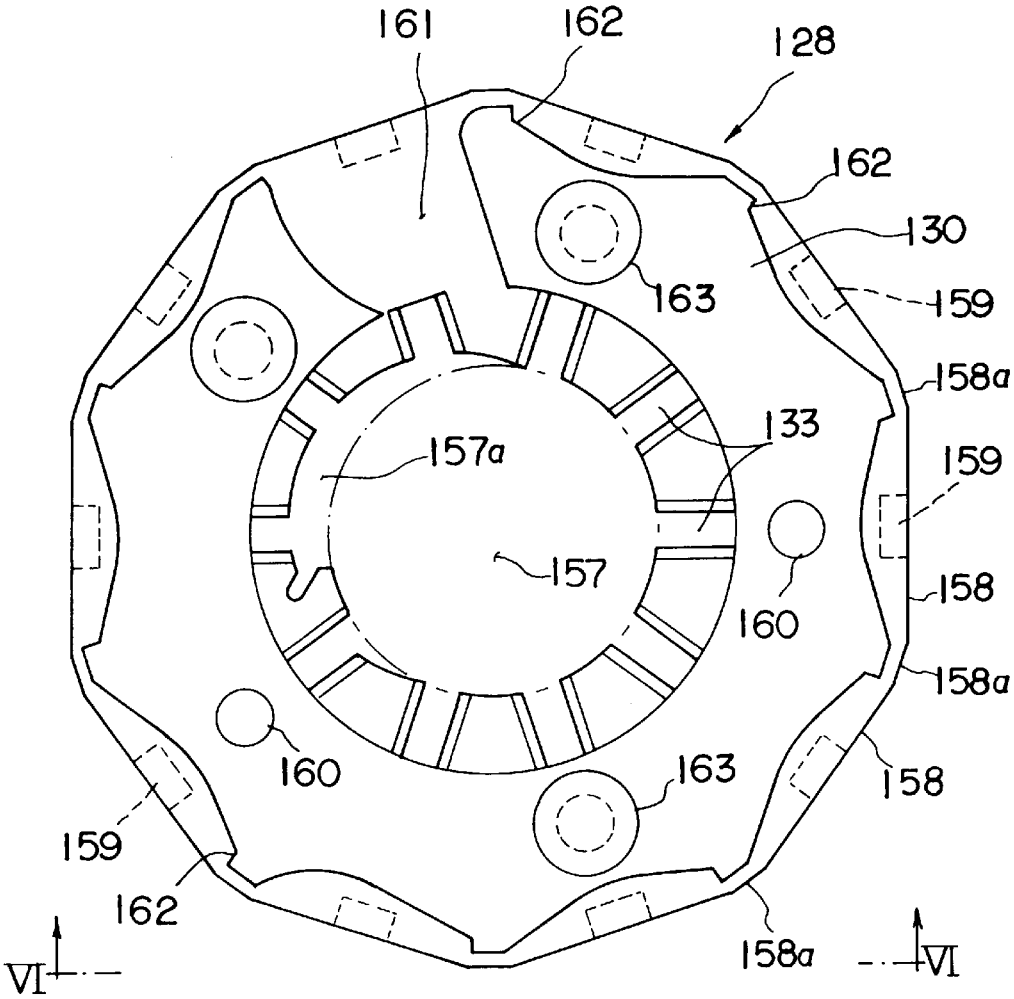
Figure 6:
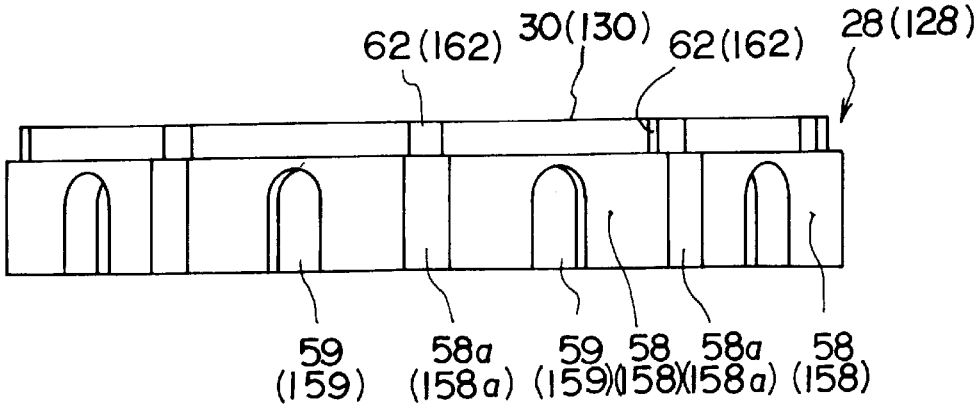
FIG. 6 is a side view taken at the line VI—VI of FIG. 5.

As shown in FIG. 5A and FIG. 6, the character wheel disc 28 constituting the character wheel 27 is formed by molding a metallic material such as aluminum, zinc, or iron or a plastic material into a wheel or disc shape so as to constitute a stamping wheel. The character wheel disc 28 may be provided with metallic plating to make it corrosion resistant. The character wheel disc 28 is configured to a polygonal shape close to a circular, e.g. a modified decagon; it has a shaft inserting hole 57 (56) at the center thereof. A plurality of, e.g. ten, mounting surfaces 58 on which printing portions (elements) 67 of the character wheel band 29 are mounted are formed on the outer periphery of the character wheel disc 28 in the circumferential direction at equal intervals of a predetermined pitch, e.g. a central angle of 36 degrees. For example, a ridge line portion (space) of about 1.25 mm between adjacent mounting surfaces 58 of the character wheel disc 28 is formed as a connecting section 58*a*, and a concave groove shaped positioning guide engaging section 59 is formed widthwise preferably at the center of each mounting surface 58. The positioning guide engaging section 59 is opened on the opposite end from the ratchet plate 30 as shown in FIG. 9 and FIG. 10. The positioning guide engaging section 59 is an engaging groove which is formed in the concave groove over almost full width of the character wheel disc 28. The positioning guide engaging section 59 may be formed into a convex engaging projection section oriented widthwise in place of the engaging groove.

Figure 9A:
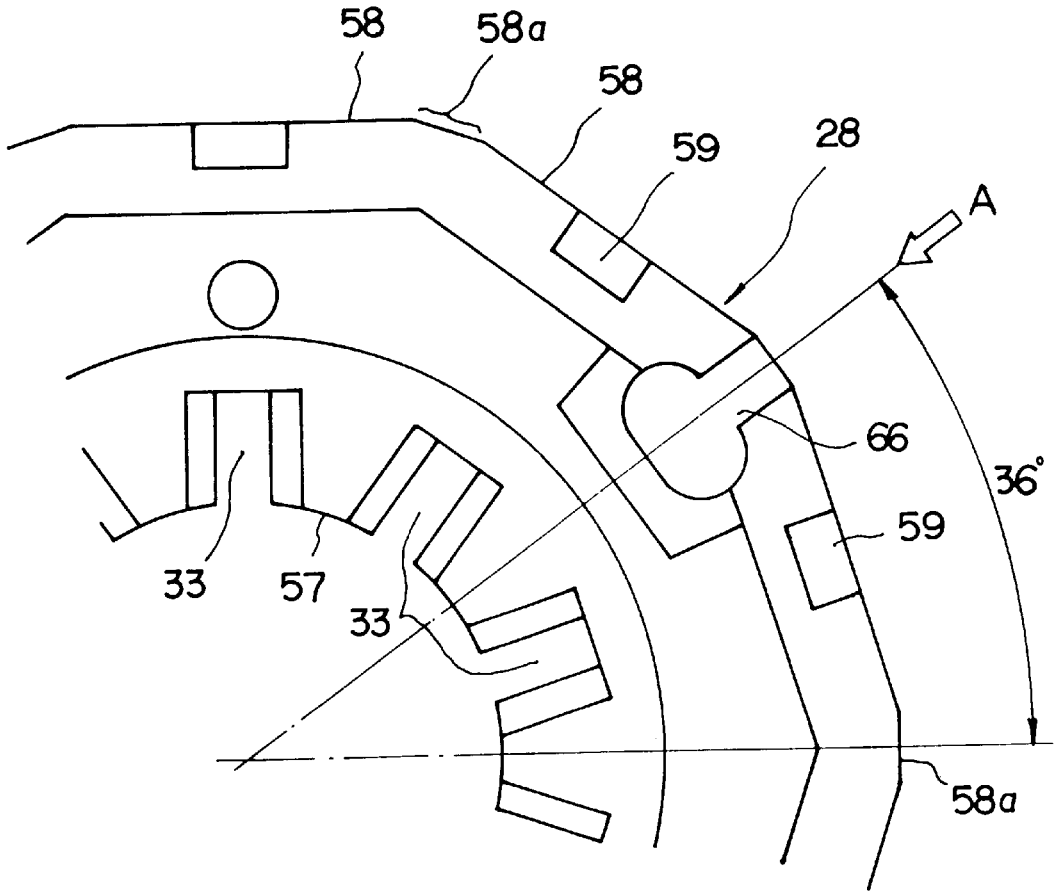
FIG. 9A is a partial rear view of the character wheel disc constituting the character wheel in accordance with the present invention, observed from the opposite side from that of FIG. 5, and FIGS. 9B and 9C are modifications of FIG. 9A.
Figure 9B:
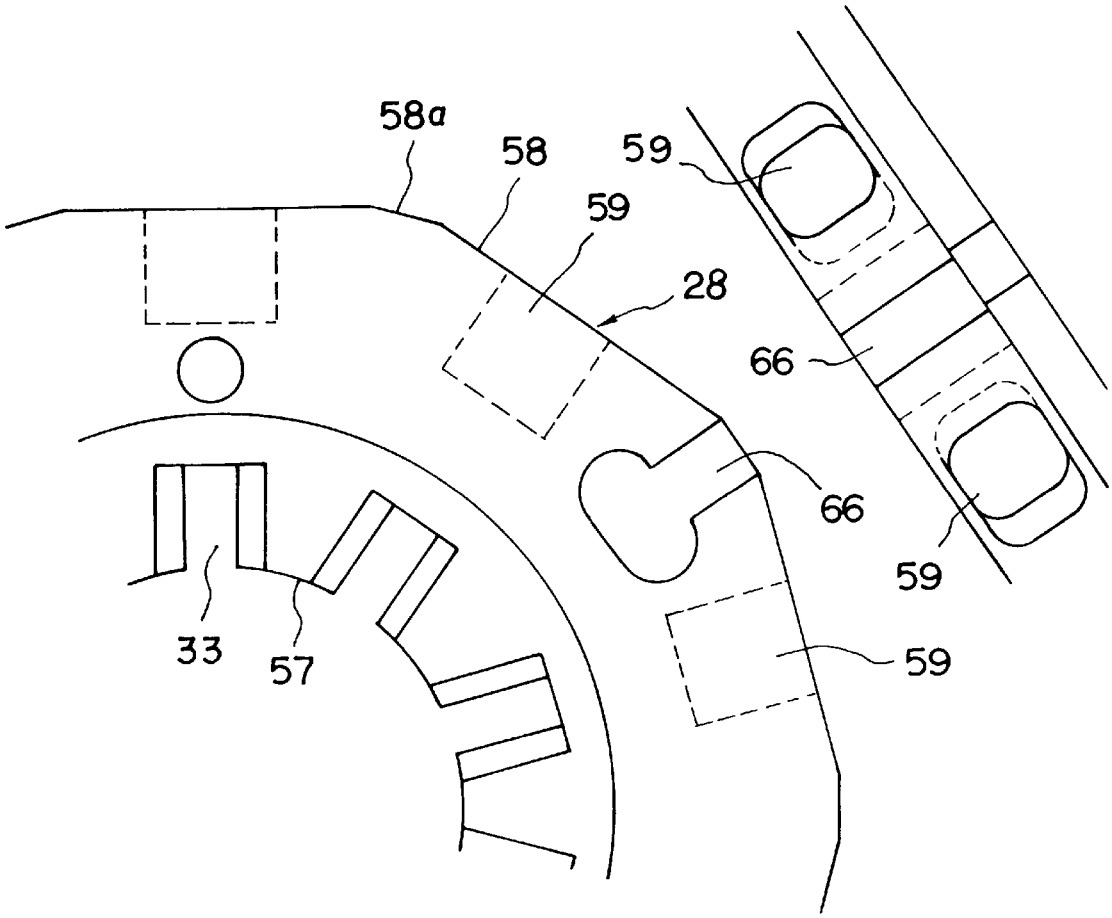
Figure 9C:
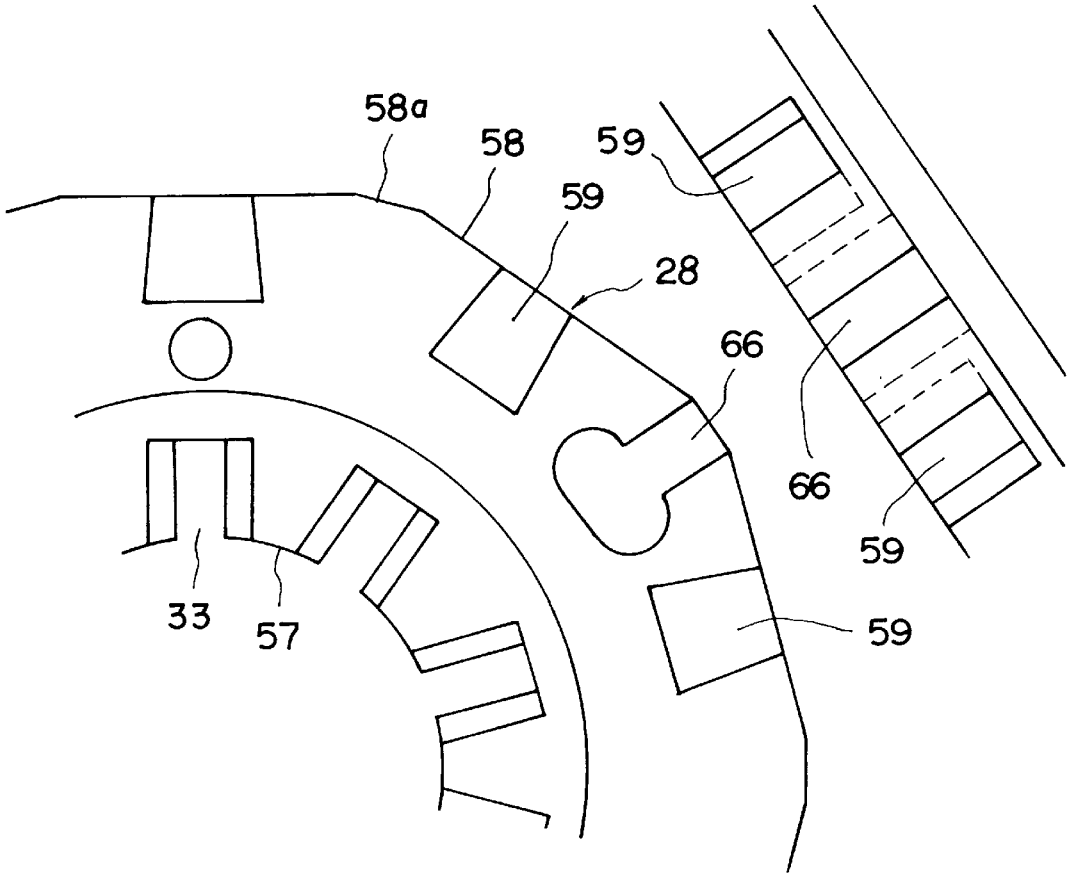
Figure 10:
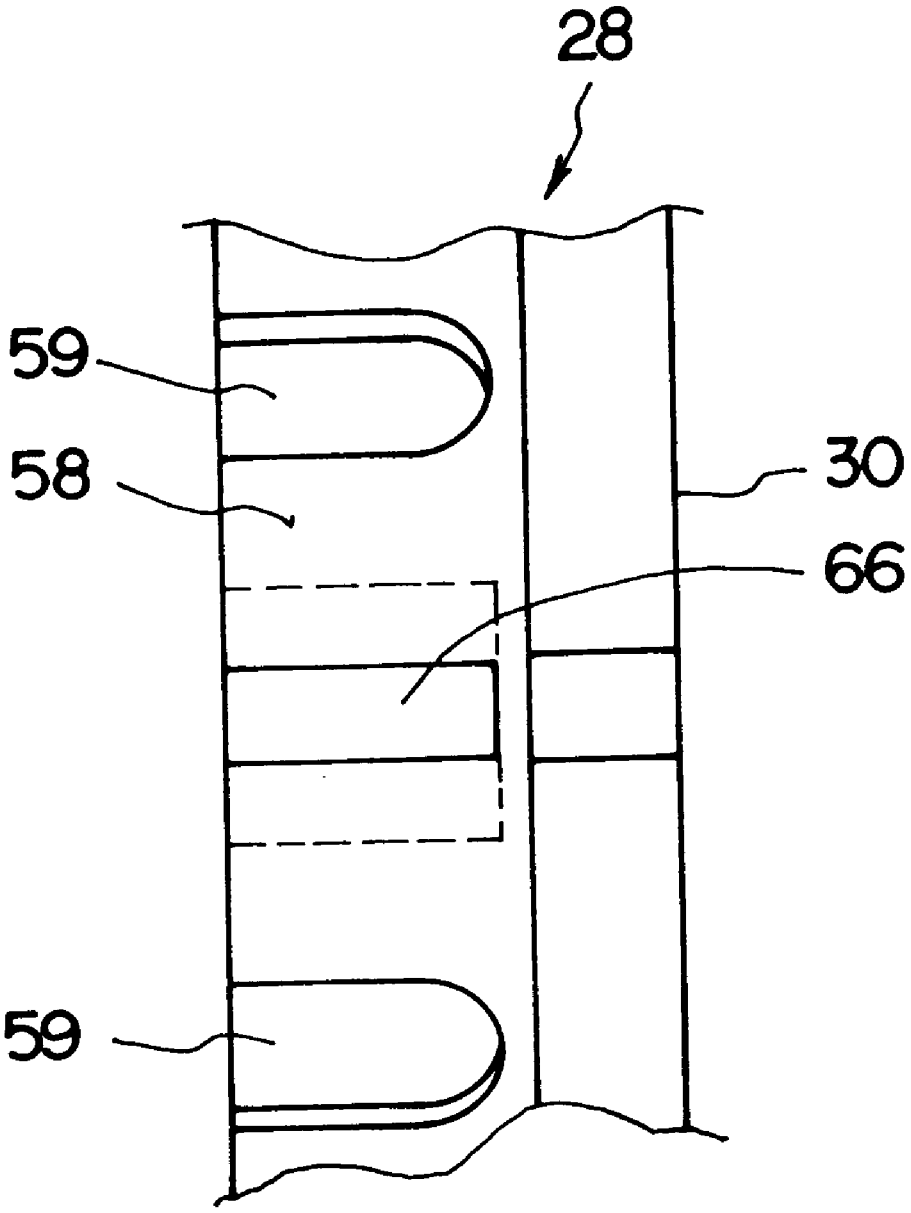
FIG. 10 is a partial view of FIG. 9A observed from direction A.
Figure 11:
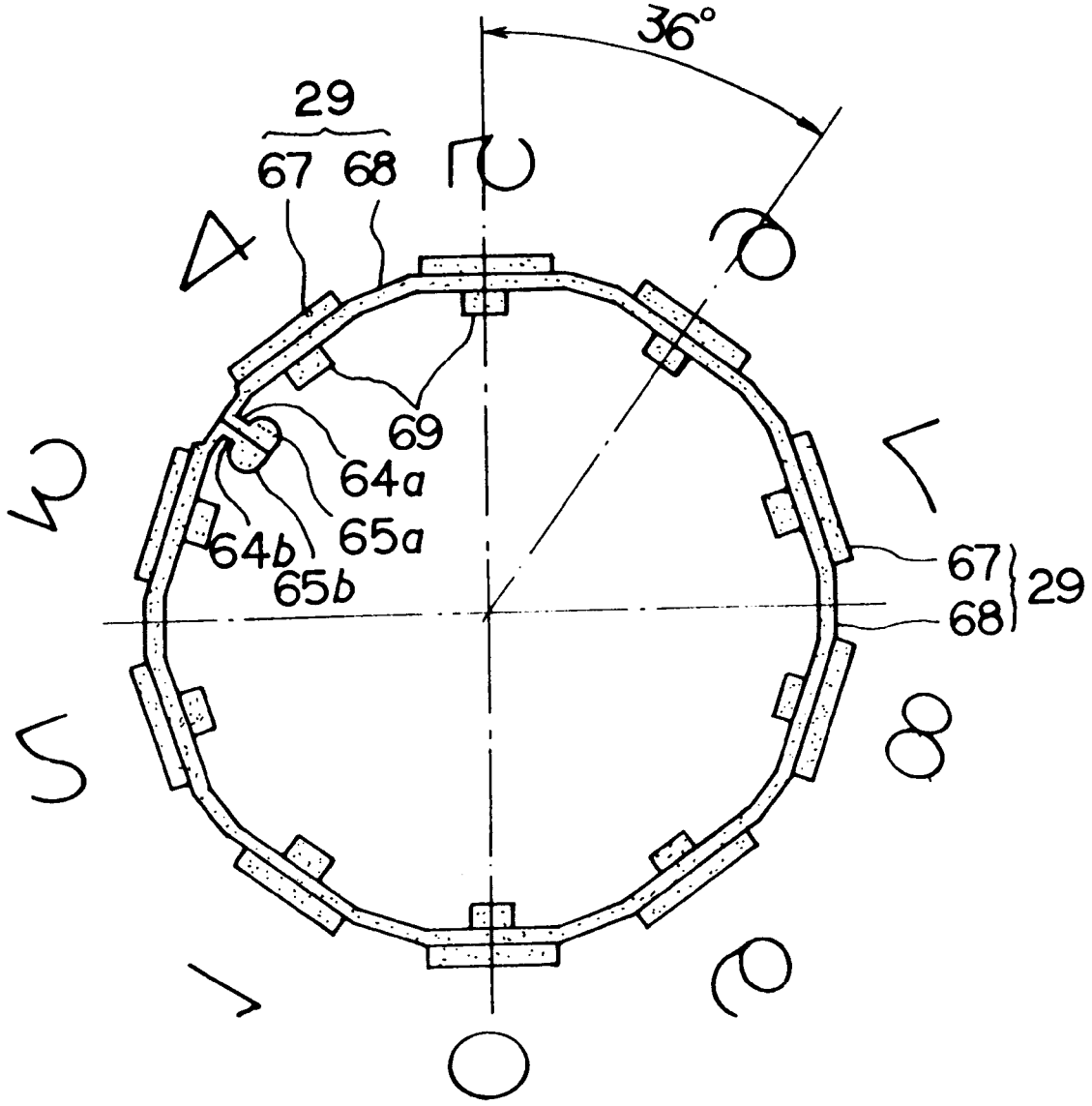
FIG. 11 is a diagram showing a flexible character wheel band constituting the character wheel of the first embodiment of the present invention, the flexible character wheel band having been modified to have a circular shape.

FIG. 9A is an illustration of one example of the character wheel disc 28 provided with the engaging section (groove) 59 having a shallow rectangular shape in section which is engaged with the engaging projection 69 of FIGS. 12A1 and 12A2 of the character wheel band 29, FIG. 9B is a modified example of the character wheel disc 28 provided with the engaging section 59 having relatively deep rectangular shape in section, for ensuring more firm engagement, which is engaged with the projection 69 of FIGS. 12B1 and 12B2 of the character wheel band 29, and FIG. 9C is another modified example of the character wheel disc 28 with the engaging section having trapezoidal shape in section, having one opened end, which is slidably engaged with the projection 69 of FIGS. 12Cl and 12C2 of the character wheel band 29. It is to be noted that the shape of the engaging section and projection of the character wheel disc and the character wheel band may be selected variously without being limited to the above examples.

In FIG. 4 and FIG. 5A, reference numeral 33 denotes a plurality of selector grooves for selecting the printing portions of the character wheels 27 by a printing portion internal selecting mechanism, not shown. A positioning guide engaging section (portion) 59 is formed, as an engaging groove, so as to across, in the width direction, the character wheel disc 28 substantially over the entire width thereof and to open to one side surface of the disc 28. This engaging groove may be substituted with an engaging projection.

A plurality of guide pins are integrally provided on the other side surface of the character wheel disc 28, and the feed ratchet plate 30 is attached by the guide pins 60. The feed ratchet plate 30 is shaped like an arc as a whole, and an opening 61 for carrying is formed in a portion on the periphery thereof, a feed ratchet 62 which serves as a stamp wheel cam being formed on the outer peripheral surface thereof. The feed ratchet 62 selectively engages with the reverse rotation preventing member 32 so that the character wheels 27 may be prevented from rotating in the reverse direction.

The feed ratchet plate 30 is attached to the side surface of the character wheel disc 28 and fixed by riveting with a securing means such as a metallic rivet 63 to form them into one piece. FIG. 5A and FIG. 6 illustrate an example wherein the character wheel disc 28 and the feed ratchet plate 30 are formed as separate components, then combined into one assembly. However, the character wheel disc 28 and the feed ratchet plate 30 may alternatively be made into one piece beforehand through a molding process.

Figure 7A:
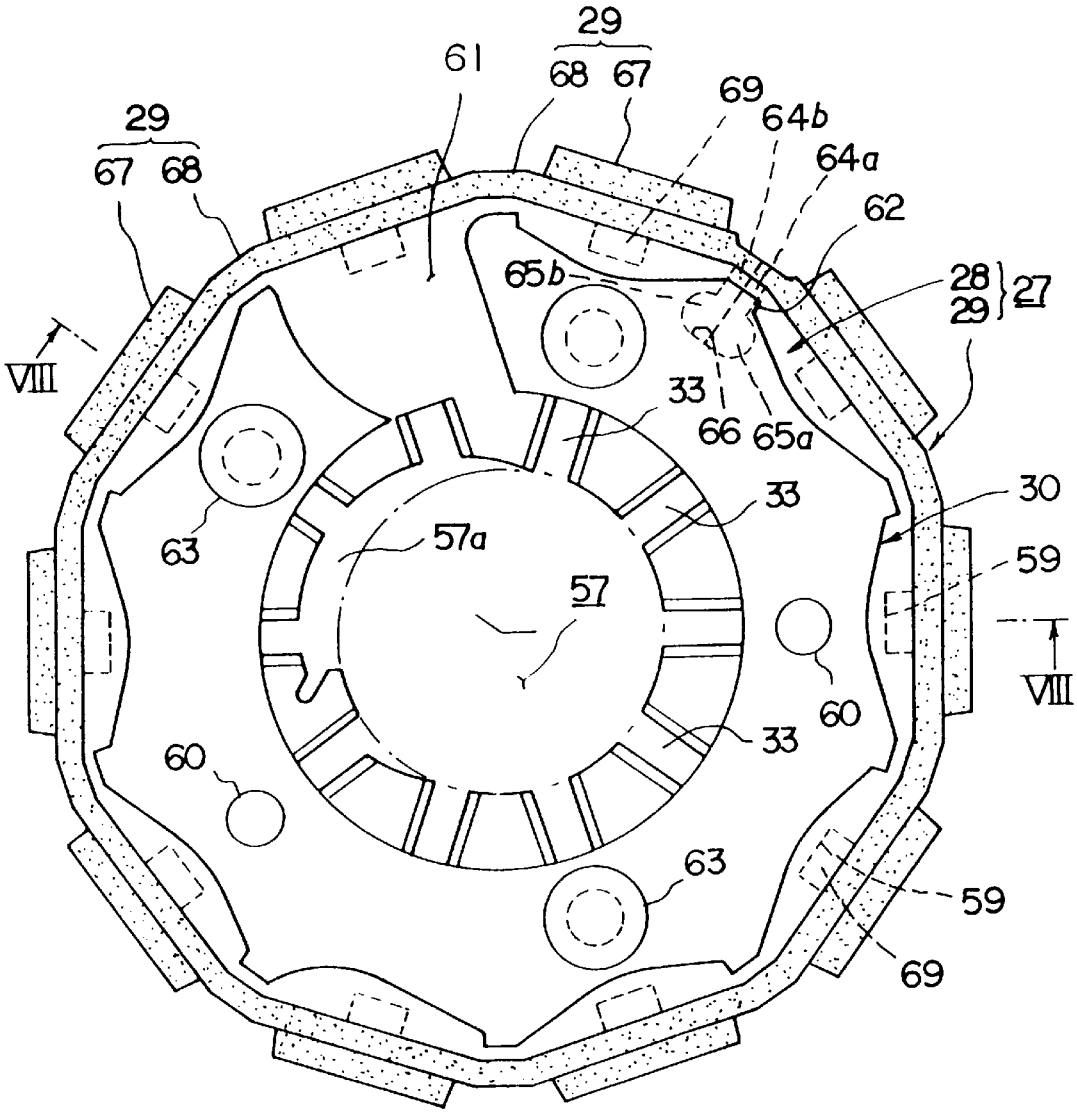
FIG. 7 is a front view illustrative of an embodiment of the character wheel representing the first embodiment (FIG. 7A) and the second embodiment (FIG. 7B) of the present invention.
Figure 8:
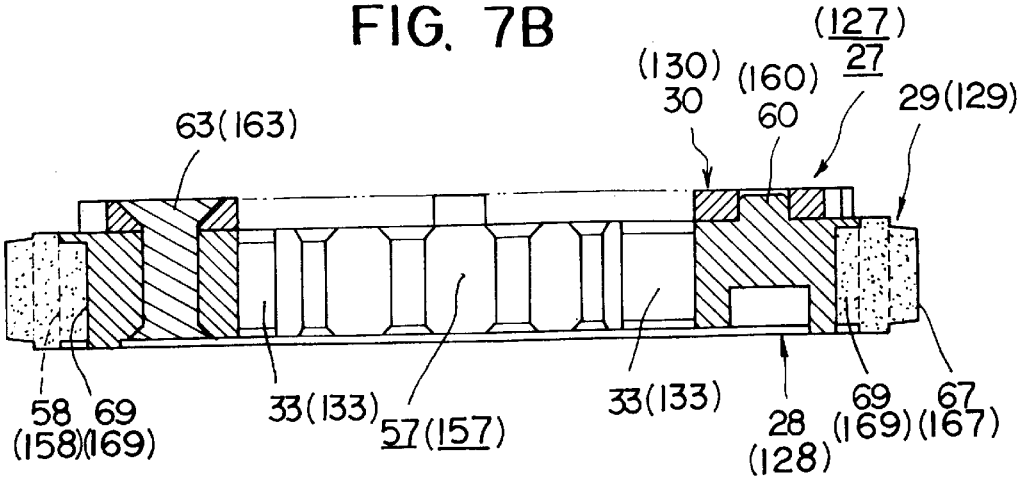
FIG. 8 is a sectional view taken at the line VIII—VIII of FIG. 7.

The rubber character wheel band 29 is attached to the outer periphery of the character wheel disc 28 to make up the character wheel 27 as shown in FIG. 7A and FIG. 8. As shown in FIGS. 12A1 and 12A2, the rubber character wheel band 29 has steps at both ends thereof where thin junctions 64*a*, 64*b* are formed, and approximately semi-spherical engaging projections 65*a*, 65*b* are integrally formed on the rear surfaces of the junctions 64*a*, 64*b*. The character wheel band 29 is mounted on the outer periphery of the character wheel disc 28, the engaging projections 65*a*, 65*b* at both ends fit and engage in an engaging groove 66 of the character wheel disc 28. The engaging projections 65*a*, 65*b* at both ends of the rubber character wheel band 29 are bent inward, and when the bent sections are butted against each other, the butted shapes (joined shapes) of the engaging projections 65*a*, 65*b* become approximately spherical, elliptic spherical, or oval spherical and the engaging groove 66 is formed into a shape which almost snugly accommodates the joined junctions 64*a*, 64*b* and the engaging projections 65*a*, 65*b*. The groove is formed, for example, to have a width of approximately 1 mm at the inlet end thereof and a nearly oval or elliptical bulged section (e.g. the major axis thereof is about 2.6 mm) inside.

The engaging groove 66 of the character wheel disc 28 is provided in at least one connecting section (portion) 58*a* between adjoining printing portion mounting surfaces 58 on the outer periphery of the disc, and the engaging groove 66 in which the engaging projections 65*a*, 65*b* at both ends of the rubber character wheel band 29 are engaged and locked is formed so as to make it possible to dispose, for example, ten characters such as numerals from 0 to 9 on the decagon character wheel disc 28, thus enabling a character wheel suited for the numbering machine to be supplied. The engaging groove 66 is formed over nearly full width of the character wheel disc 28 and opened at one disc side surface end as in the case of the positioning guide engaging section 59. If the character wheel disc 28 is formed to have, for instance, a dodecagonal shape, then it is able to supply a data printing element stamping character wheel for printing, for example, months.

A decimal numbering machine requires decagonal character wheels 27. If the conventional character wheel which uses the space for one character by making use of the engaging section is employed for the numbering machine, then undecagonal character wheel discs would be required and the numbering machine would be an undenary numbering machine. However, the undenary numbering machine is utterly unfeasible. In case of a numbering machine, decagonal character wheels 27 and decimal notation are essential factors.

Figure 14:
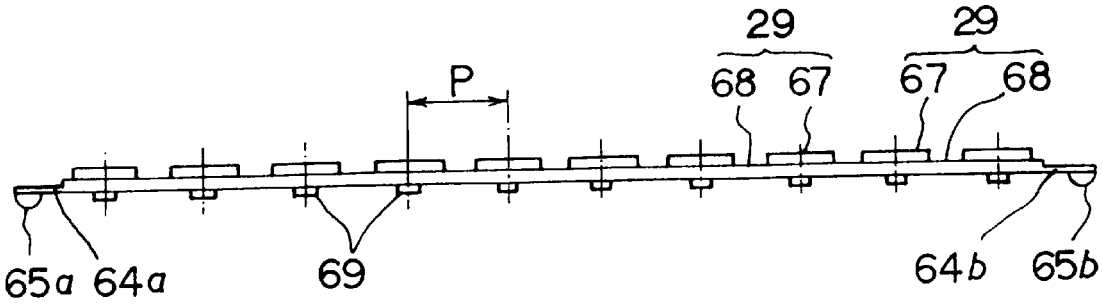
FIG. 14 is a side view of the character wheel plate shown in FIG. 11.

The front surface of the flexible character wheel band 29 is provided with a plurality of printing portion 67 on which numerals, characters, symbols, etc. are formed and which are disposed at equal intervals of a desired pitch, for example, about 7 mm; the printing portions 67 are connected into one piece by a connecting portion 68 to form a band having a width of, for example, 3 mm. As shown in FIG. 12 and FIG. 14, the printing portions 67 of the flexible character wheel band 29 are provided in a row at a pitch of, for example, about 7 mm, at equal intervals P of a central angle of 36 degrees when there are, for example, ten printing portions (elements), and the printing portions 67 are provided with, for example, numerals from 0 to 9. The printing portions 67 may alternatively be configured to form blocks, which will be connected into one piece by the connecting portion. Formed on the back surfaces of the type elements 67 are positioning engaging sections 69 which can be fitted and engaged with the positioning guide engaging sections 59 of the character wheel disc 28. When the positioning guide engaging sections 59 are engaging grooves, the positioning engaging sections 69 are formed into projections so that they may fit in the engaging grooves.

The printing portions 67 of the character wheel band 29 are formed to correspond to the positioning guide engaging sections 59 of the character wheel disc 28. The selector grooves 33 are formed at the center of the character wheel disc 28 to correspond to the printing portions 67 and the positioning guide engaging sections 59 so that the printing portion internal selecting mechanism, not shown, may engage with the selector grooves 33. The selector grooves 33 are arranged radially at predetermined intervals around the shaft inserting hole 57 of the character wheel disc 28 and opened at the shaft inserting hole 57 end.

The character wheel band 29 is positioned and properly installed on the outer periphery of the character wheel disc 28 by fitting the positioning engaging section 69 in the positioning guide engaging section 59 of the character wheel disc 28, and the engaging projections 65*a*, 65*b* at both ends of the character wheel band 29 are engaged with the engaging groove 66 of the character wheel disc 28 to lock them, thus composing the character wheel 27. More specifically, the character wheel band 29 is turned inside out, the junctions 64*a*, 64*b* at both ends thereof are butted against each other, then, with the butted state maintained, the junctions 64*a*, 64*b* and the engaging projections 65*a*, 65*b* are inserted in the engaging groove 66 of the character wheel disc 28 through the side opening to engage them. With the junctions 64*a*, 64*b* and the engaging projections 65*a*, 65*b* engaged and fitted in the engaging groove 66, the character wheel band 29 is turned back, and the positioning engaging sections 69 of the character wheel band 29 are engaged in the positioning guide engaging sections 59 of the character wheel disc 28 so as to properly attach the character wheel band 29 to the outer periphery of the character wheel disc 28.

The character wheel 27 can be easily fabricated simply by attaching the character wheel band 29 to the outer periphery of the character wheel disc 28 and by securing the engaging projections 65*a*, 65*b* at both ends in the engaging groove 66 of character wheel disc 28 without joining both ends of the character wheel band 29 with an adhesive agent. Since the character wheel 27 does not require a junction in the character wheel band 29, there is no possibility of a junction from peeling off.

Figure 13:
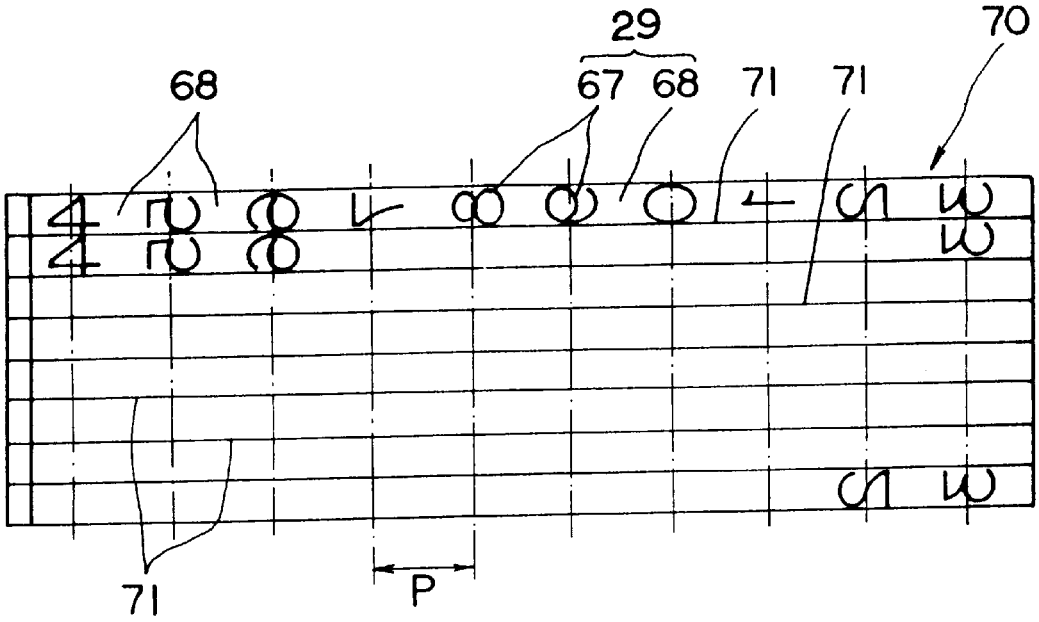
FIG. 13 is a top plan view illustrative of a character wheel plate formed by vulcanizing press molding.

Further, the rubber character wheel band 29 constituting the character wheel 27 is obtained from the character wheel plate 70 formed by vulcanizing press. As shown in FIG. 13 and FIG. 14, the character wheel plate 70 is formed into a rectangular shape by tearing off the excess portion around the periphery of the plate formed by means of vulcanizing press. The character wheel plate 70 is composed of a plurality of (e.g. eight) character wheel bands 29 which are connected in parallel into one piece via linear weakened areas 71 shown in FIG. 15 and FIG. 16.

Figure 15:
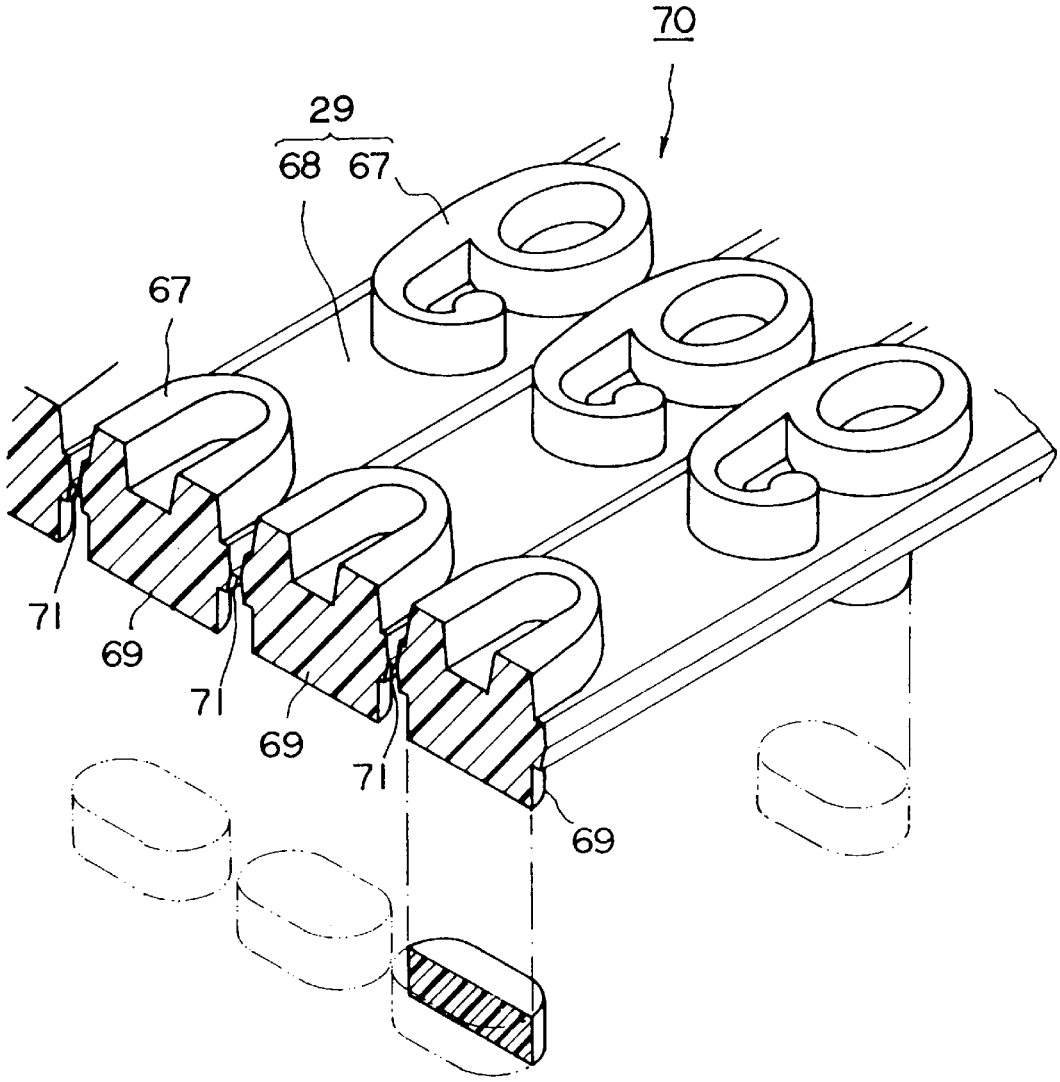
FIG. 15 is an enlarged partial perspective view illustrative of the character wheel plate shown in FIG. 13.
Figure 16:
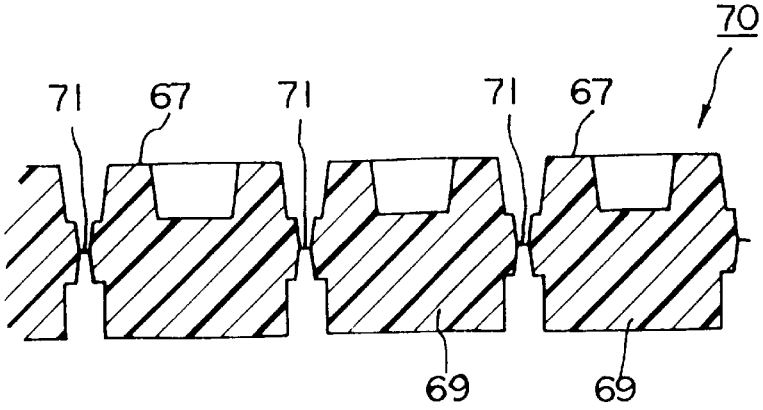
FIG. 16 is a sectional view illustrative of the character wheel plate shown in FIG. 15.
Figure 17:
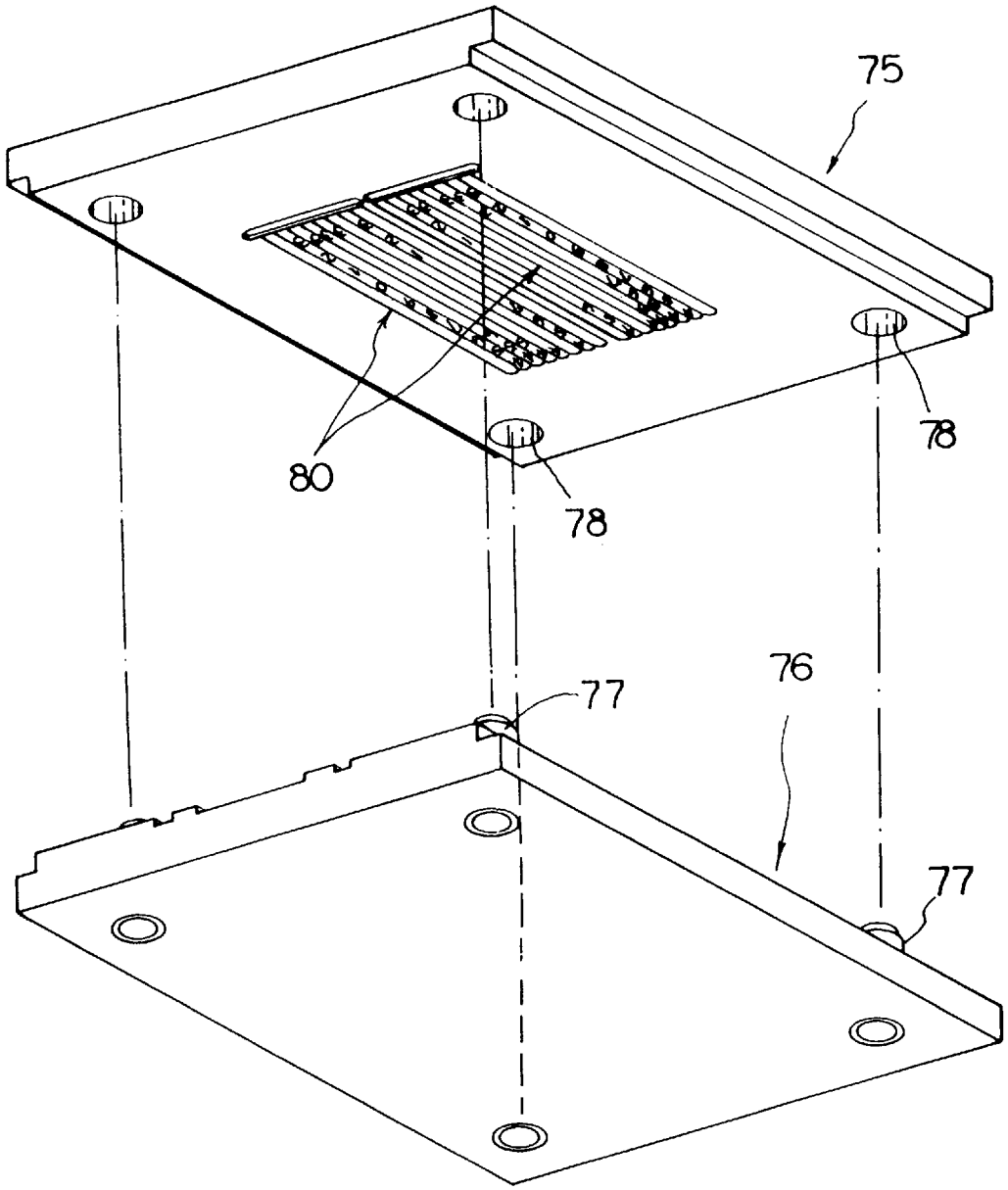
FIG. 17 is a diagram showing the upper and lower mold blocks of the vulcanizing press for manufacturing the character wheel plate shown in FIG. 13.
Figure 18:
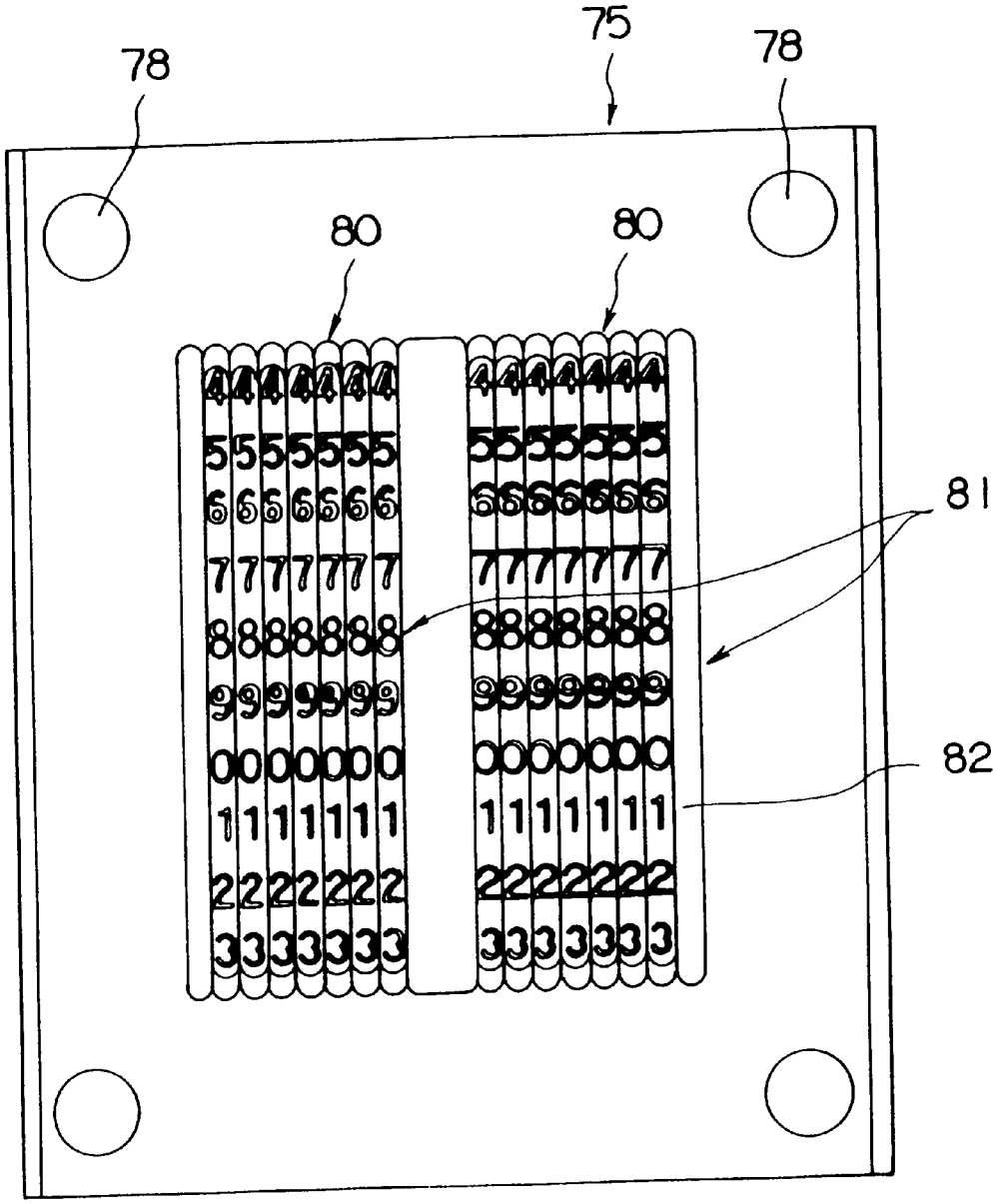
FIG. 18 is a diagram showing the upper (or the lower) mold block of the vulcanizing press.
Figure 19:
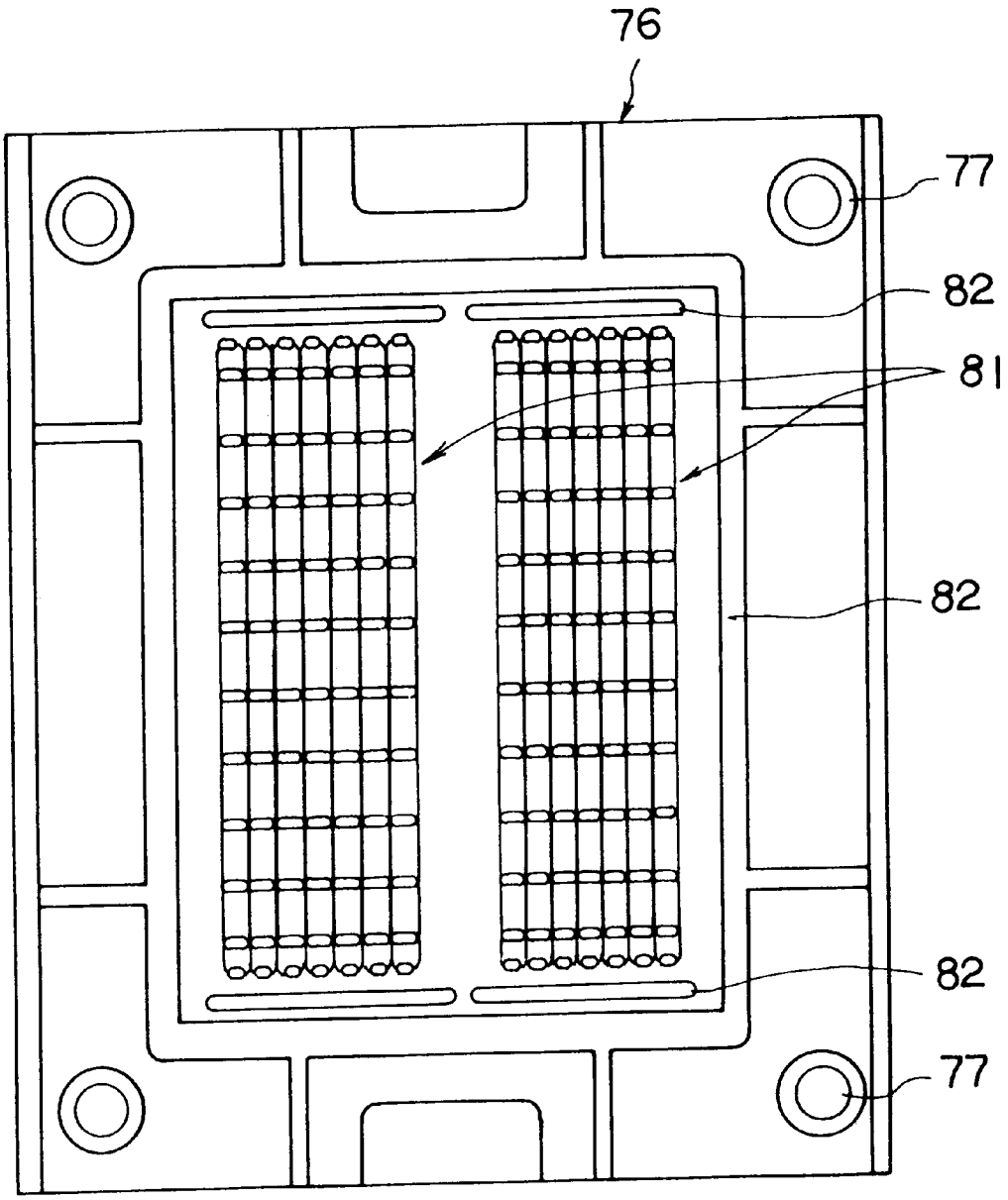
FIG. 19 is a diagram showing the lower (or the upper) mold block of the vulcanizing press.

As shown in FIG. 17 through FIG. 19, the character wheel plate 70 is formed by vulcanizing and molding unvulcanized rubber sheet by employing vulcanizing press mold blocks 75 and 76. The mold blocks 75 and 76 are metallic split-cavity mold blocks which are vertically split into two blocks and which are made of iron, copper, aluminum, or other metal; the lower mold block 76 is provided with mold registering guide pins 77 at its four corners, and guide holes 78 of the upper mold 75 engage with the guide pins 77 to register the upper and lower mold blocks 75 and 76. Formed at the central sections of the upper and lower mold blocks 75 and 76 are processing surfaces 80 and 81 serving as the molding surfaces for forming the character wheel plate 70. At least one of the mold blocks is provided with a reservoir groove 82 around the processing surfaces 80 and 81. The mold blocks 75 and 76 are heated to a temperature of 140 to 155° C., preferably 150° C. and subjected to molding by the vulcanizing press to make the character wheel plate 70. In the character wheel plate 70, the character wheel bands 29 are joined in parallel via the weakened areas (linear weakened areas) 71 as illustrated in FIG. 15 and FIG. 16. The weakened areas 71 are formed by setting the gap between the upper and lower mold blocks 75 and 76 to nearly zero. The vertical relationship between the upper and lower mold blocks 75 and 76 is not limited to that shown in FIG. 17 to FIG. 19, and the vertical relationship of the mold blocks 75 and 76 may be reversed.

The manufacture of the character wheel plate 70 is implemented as set forth below.

An unvulcanized rectangular rubber plate made of synthetic rubber, natural rubber, or the like is placed on the processing surfaces of the lower mold block 76. After this process, the upper and lower mold blocks 75 and 76 are registered by utilizing the guide pins 77 and pressed by the vulcanizing press. By using a hot plate or heater, the mold blocks 75 and 76 are heated to 140 to 155° C., preferably, 150° C., so as to mold and vulcanize the unvulcanized rubber sheet. When pressurizing the upper and lower mold blocks 75 and 76, venting is repeatedly carried out to prevent gas or the like from being included in the character wheel plate 70 to be formed during the vulcanizing and molding process.

After the unvulcanized rubber sheet has been formed by using the upper and lower mold blocks 75 and 76 and by the vulcanizing press, the upper and lower mold blocks 75 and 76 are released, and the vulcanized and formed plate is removed from the mold blocks 75 and 76. The peripheral portion of the formed plate removed from the mold blocks 75 and 76 is torn off to finish the rectangular character wheel plate 70 shown in FIG. 13 and FIG. 14.

The character wheel plate 70 shown in FIG. 13 and FIG. 16 can be easily torn out through this tearing step by hand at the weakened areas or portions 71. The rubber character wheel bands 29 which are the flexible character wheel bands are formed. This means that no cutting device such as a cutter is required in making the character wheel bands 29, and the belt-shaped rubber character wheel bands 29 can be easily obtained by tearing the character wheel plate 70 at the weakened areas 71. The character wheels 27 can be easily manufactured by attaching the character wheel bands 29 to the outer peripheries of the character wheel discs 28.

Since the character wheel bands 29 are made of rubber, they exhibit good affinity for ink, and ink can be uniformly applied on the desired type surfaces of the printing portions on the character wheel bands 29. Hence, using the rubber character wheel bands 29 with the character wheels 27 permits sharp, clear and clean printing to be accomplished.

A character wheel and a method of manufacturing the same and a character wheel ring used for the character wheel and a method of manufacturing the same according to the second embodiment of the present invention will be further described hereunder with reference to FIGS. 1–8 and FIGS. 20–29.

Further, it is to be noted that although FIGS. 1–4, 6 and 8 are used hereunder commonly to the first embodiment and FIGS. 5B, 7B and FIGS. 20 to 29 are used for the second embodiment, the explanation is made by adding "100" to the reference numerals to the common members or parts for the easy understanding of the second embodiment of the present invention, for example, the character wheel 27 and character wheel disc 28 in the former embodiment will be mentioned in the latter embodiment as character wheel 127 and the character wheel disc 128 and the duplicated explanation thereof is omitted hereunder. It is also to be noted that, in the second embodiment, the character wheel band 29 in the first embodiment is mentioned as character wheel ring 129.

The second embodiment mainly differs from the first embodiment in the mounting method or means of the character wheel band or ring to the character wheel as clearly shown in FIGS. 5A, 5B and 7A and 7B though described in detailed hereunder.

Figure 7B:
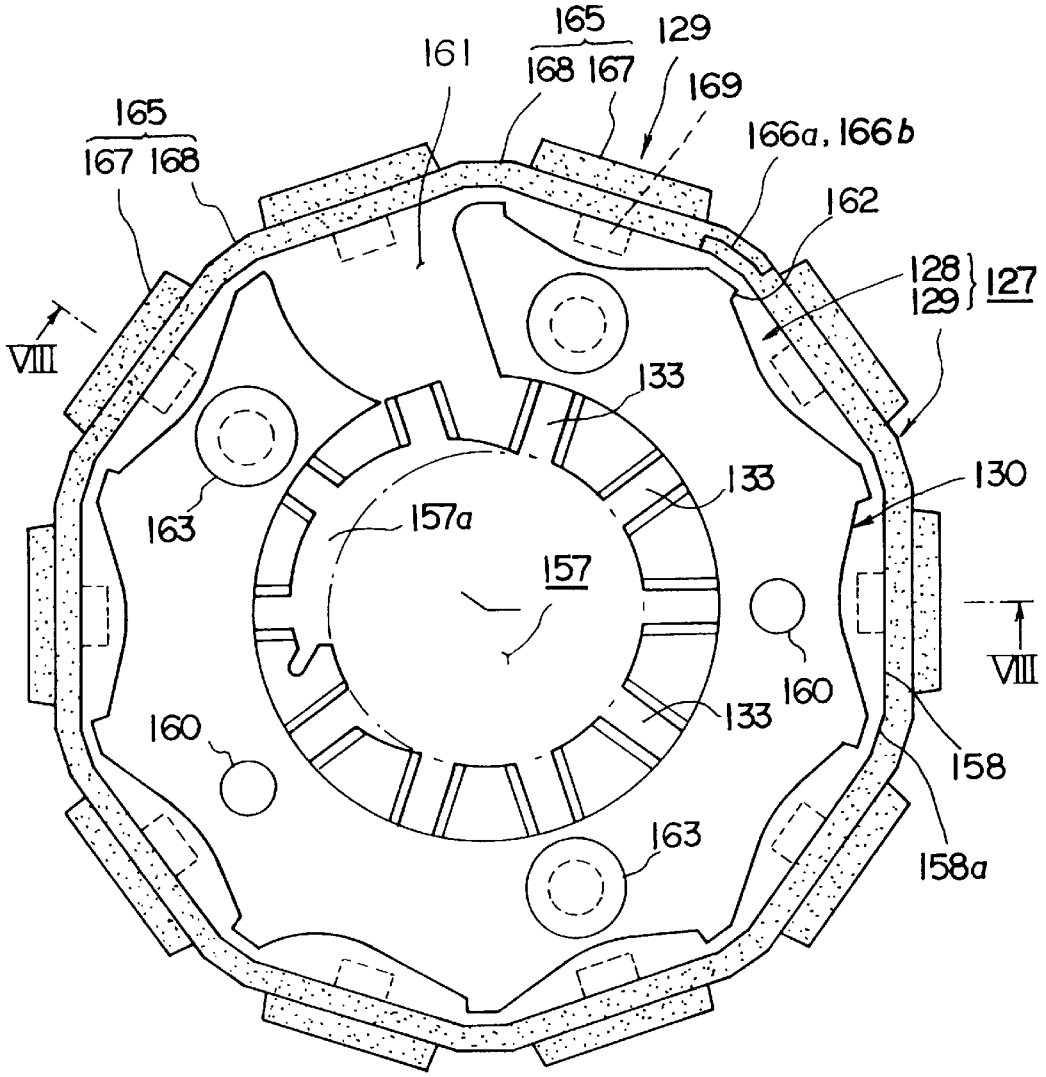

That is, in this embodiment, as shown in FIGS. 7B and 8, a character wheel ring 129 made of rubber is mounted around an outer periphery of a character wheel disc 128 to form a character wheel 127 of this embodiment.

Figure 20:
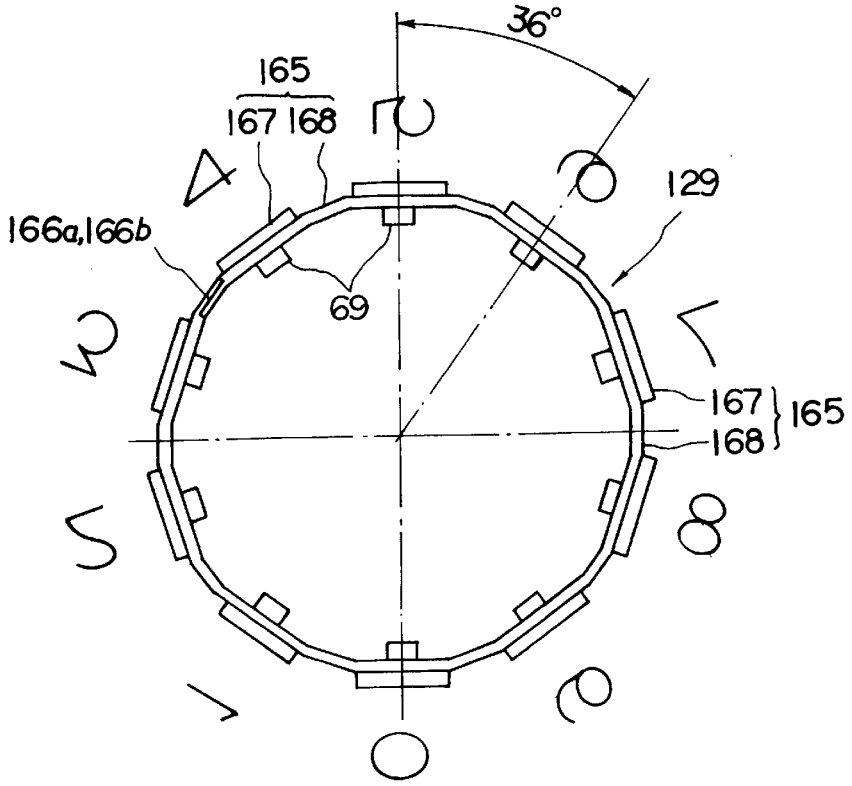
FIG. 20 is a front view of a character wheel ring constituting a character wheel according to the second embodiment of the present invention.
Figure 21A:
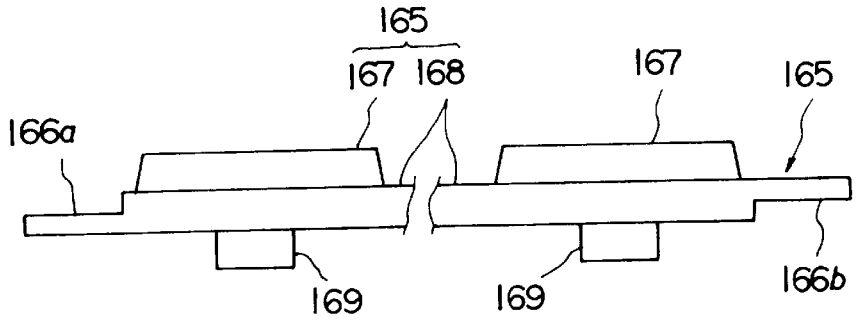
FIG. 21A is a side development view illustrative of a flexible character wheel ring of FIG. 9
Figure 21B:
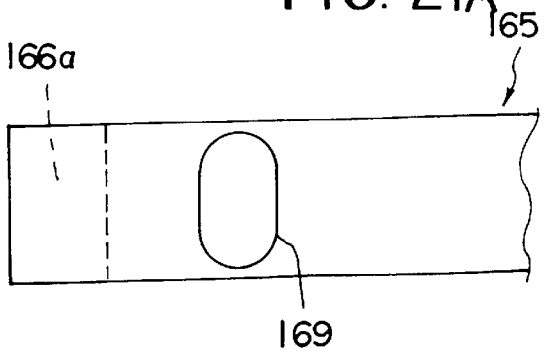
FIG. 21B illustrates one end section of the flexible character wheel band observed from the rear surface side thereof.

The character wheel ring 129 of this embodiment is formed as a flexible character wheel ring having an endless shape as shown in FIG. 20, which is formed by bonding both ends of a flexible character wheel band 165 to provide an endless shape, both the ends having cutout portions 166*a* and 166*b* in staged shapes which are overlapped and then bonded to thereby provide the endless character wheel ring 129 having flat connecting portion.

The flexible character wheel band 165 is formed with a plurality of printing portion (elements) 167 each of which is formed with numerals, letters or symbols on the front surface side thereof with an equal distance having a desired pitch, and the respective printing portions 167 are connected integrally through a connecting portion 168 to provide, for example, a band-shape having a width of 3.1 mm. The printing portions 167, ten in number for example, of the flexible character wheel band 165 are arranged, as shown in FIG. 20, in a row with equal spaces therebetween and, for example, 0 to 10 numbers are formed to the respective printing portions 167. Each of the printing portions 167 is formed so as to provide a block, and the respective blocks may be integrally connected through the connecting portions 168. Positioning guide engaging sections 159 and positioning engaging sections 169 capable of being with the engaging section 159 are formed to the rear side of the printing portions 167, and for example, when the positioning guide engaging sections 159 are formed as engaging grooves, the positioning engaging sections 167 are formed as projections to thereby achieve protrusion-recess engagement.

Further, the printing portions 167 of the character wheel ring 129 are formed so as to correspond to the positioning guide engaging sections 159 of the character wheel disc 128, and selector grooves 133 are formed to the central portions of the character wheel discs 128 so as to correspond to these printing portions 167 and the positioning guide engaging sections 159, respectively. A printing inside selection element, not shown, is formed so as to be engaged with the selector groove 133, and the selector grooves 133 are arranged radially around the shaft inserting hole 157 of the character wheel disc 128 with predetermined interval and opened to the side of the shaft inserting hole 157.

The character wheel ring 129 is positioned and accurately mounted to the outer peripheral portion of the character wheel disc 128 through the protrusion-recess engagement between the respective positioning engaging sections 169 and the positioning guide engaging sections 159, thus constructing the character wheel 127. That is, the character wheel 127 can be easily assembled merely by fitting and mounting the character wheel ring 129 to the outer peripheral portion of the character wheel disc 128.

In this embodiment, the engaging section 159 may also be formed to provide various shapes as shown in FIGS. 9A to 9C and 12A to 12C as in the first embodiment.

Figure 22:
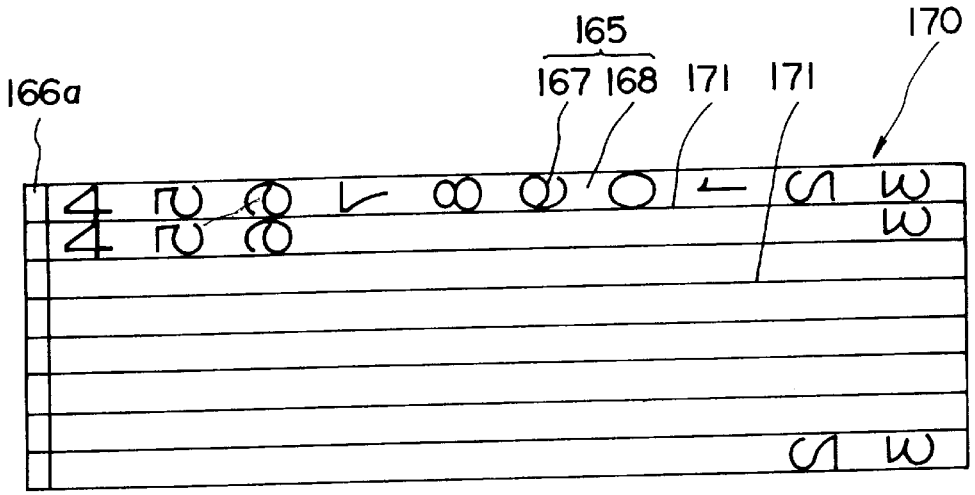
FIG. 22 is a plan view of a character wheel plate formed through a vulcanization molding process.
Figure 23:
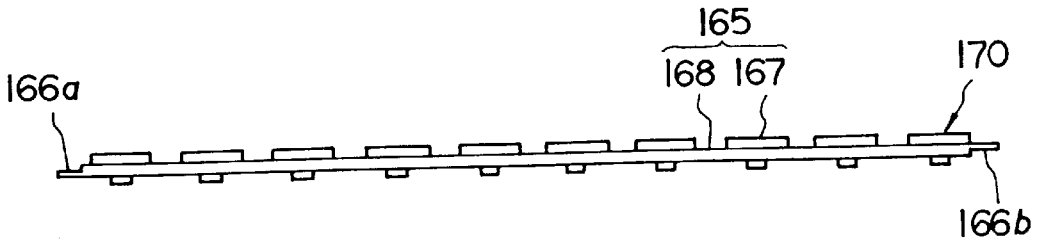
FIG. 23 is a side view of the character wheel plate shown in FIG. 22.
Figure 24:
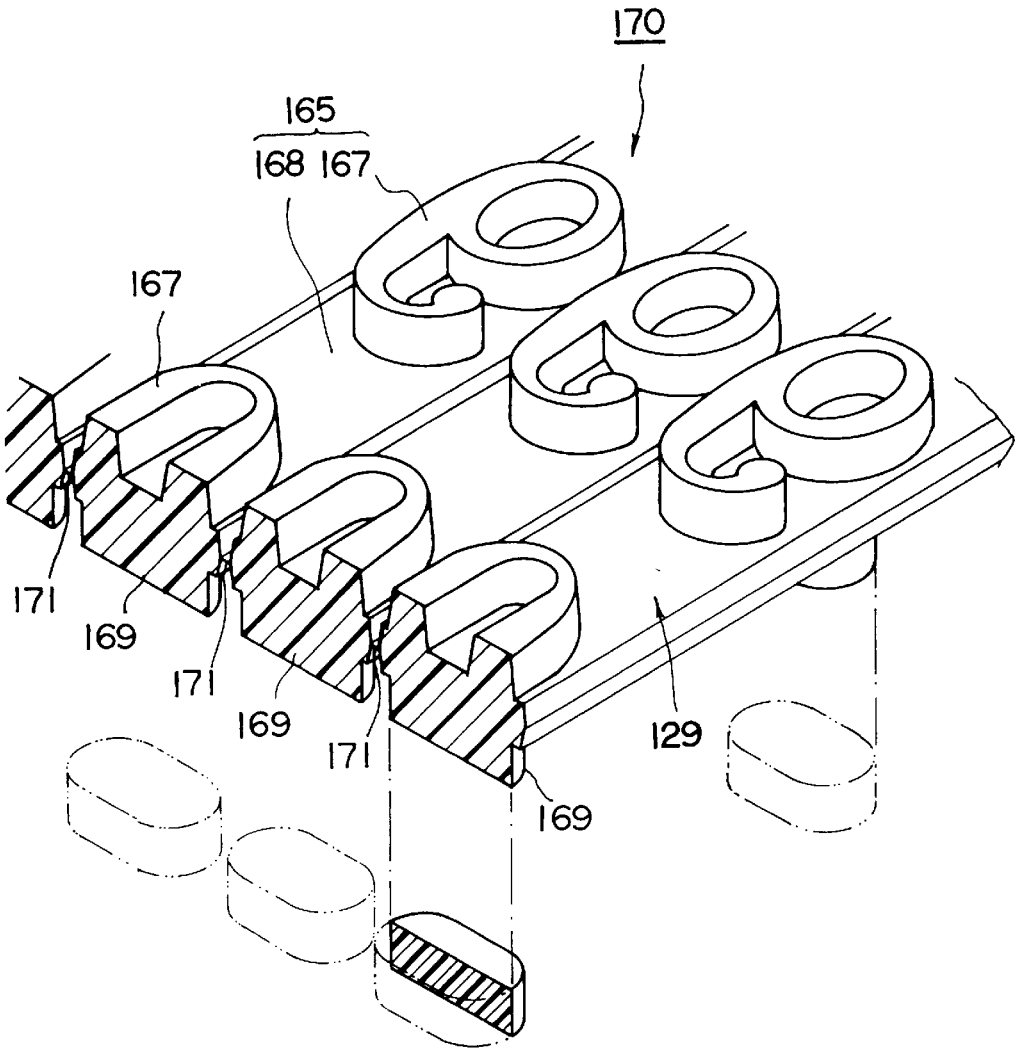
FIG. 24 is a perspective view of the character wheel plate shown in FIG. 22 in an enlarged scale, for example, in ten times.
Figure 25:
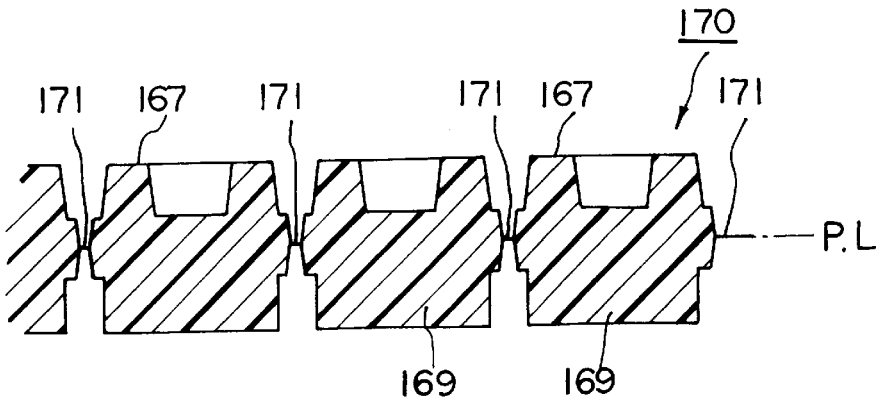
FIG. 25 is a side sectional view of the character wheel plate shown in FIG. 24.
Figure 26:
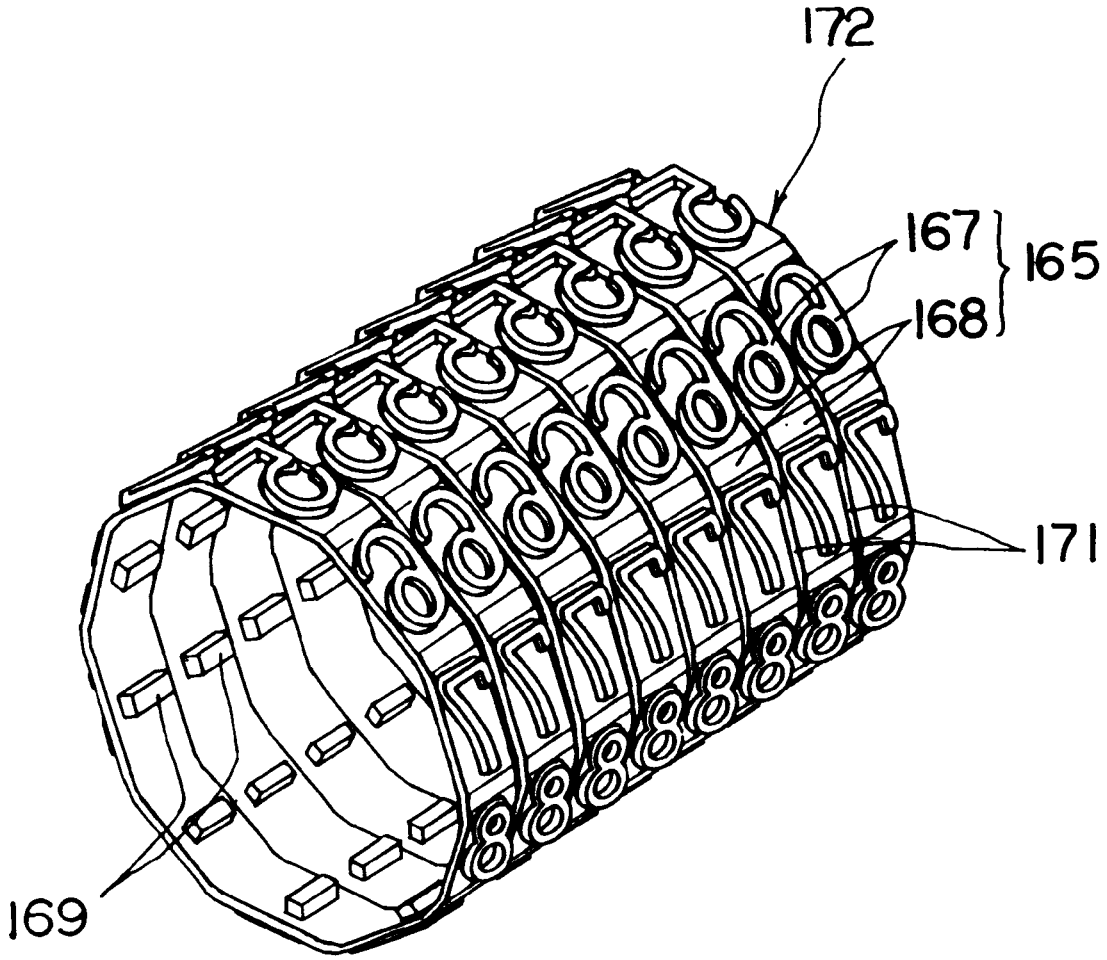
FIG. 26 is a perspective view of a character wheel sleeve formed by joining both ends of the character wheel plate shown in FIG. 22.

The rubber character wheel ring 129 constituting the character wheel 127 is formed by joining both the longitudinal ends of the flexible character wheel band 165, which is formed from the character wheel plate 170 formed through a vulcanizing molding process by means of vulcanizing press. The character wheel plate 170 is formed into a rectangular shape as shown in FIGS. 22 and 23 by cutting a bleeding (excessive) portion from the peripheral portion of the vulcanized plate. The character wheel plate 170 is composed of a plurality of flexible character wheel bands 165, for example, eight as shown in FIG. 22, which are integrally connected in parallel to each other through weakened linear areas 171 as shown in FIGS. 24 and 25 in an enlarged scale, and as shown in FIG. 26, the character wheel sleeve 172 is formed by joining both the ends of the character wheel plate 170.

Although the manufacturing processes of the character wheel plate 170 are substantially the same as those mentioned with reference to the first embodiment, these processes will be described more in detail hereunder.

Figure 27:
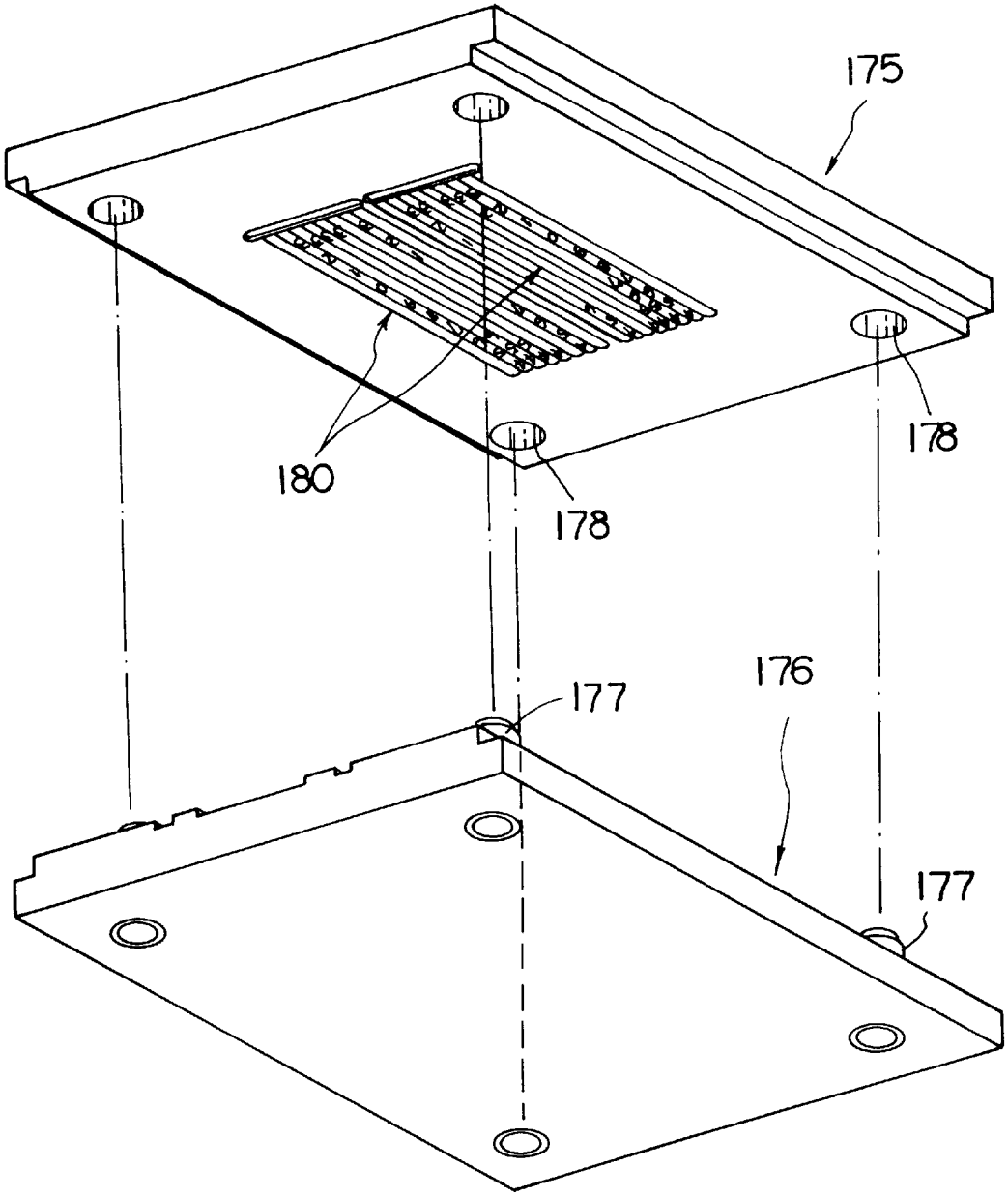
FIG. 27 is a diagram showing the upper and lower mold blocks of the vulcanizing press for manufacturing the character wheel plate shown in FIG. 22.
Figure 28:
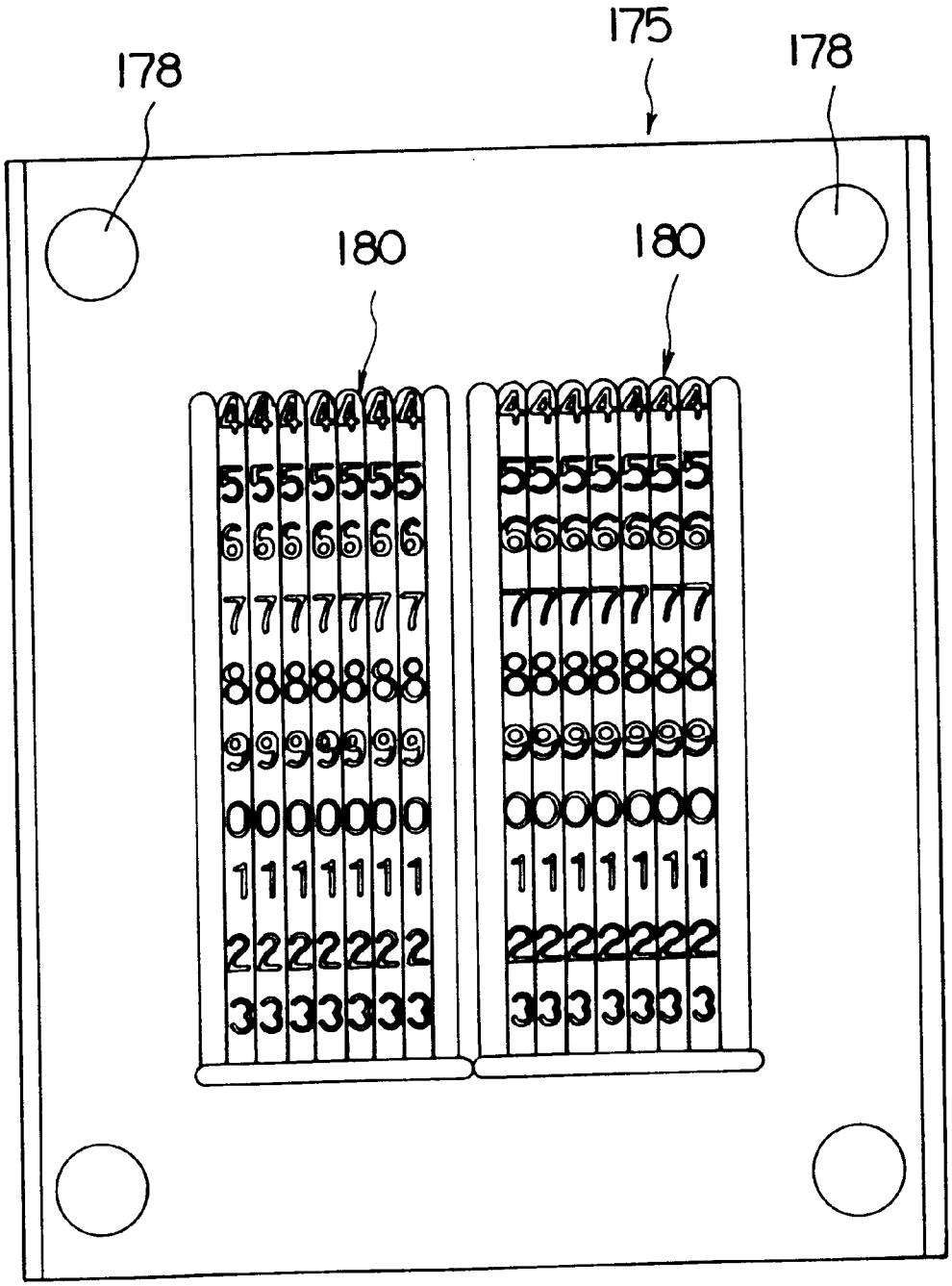
FIG. 28 is a diagram showing the upper (or the lower) mold block of the vulcanizing press.
Figure 29:
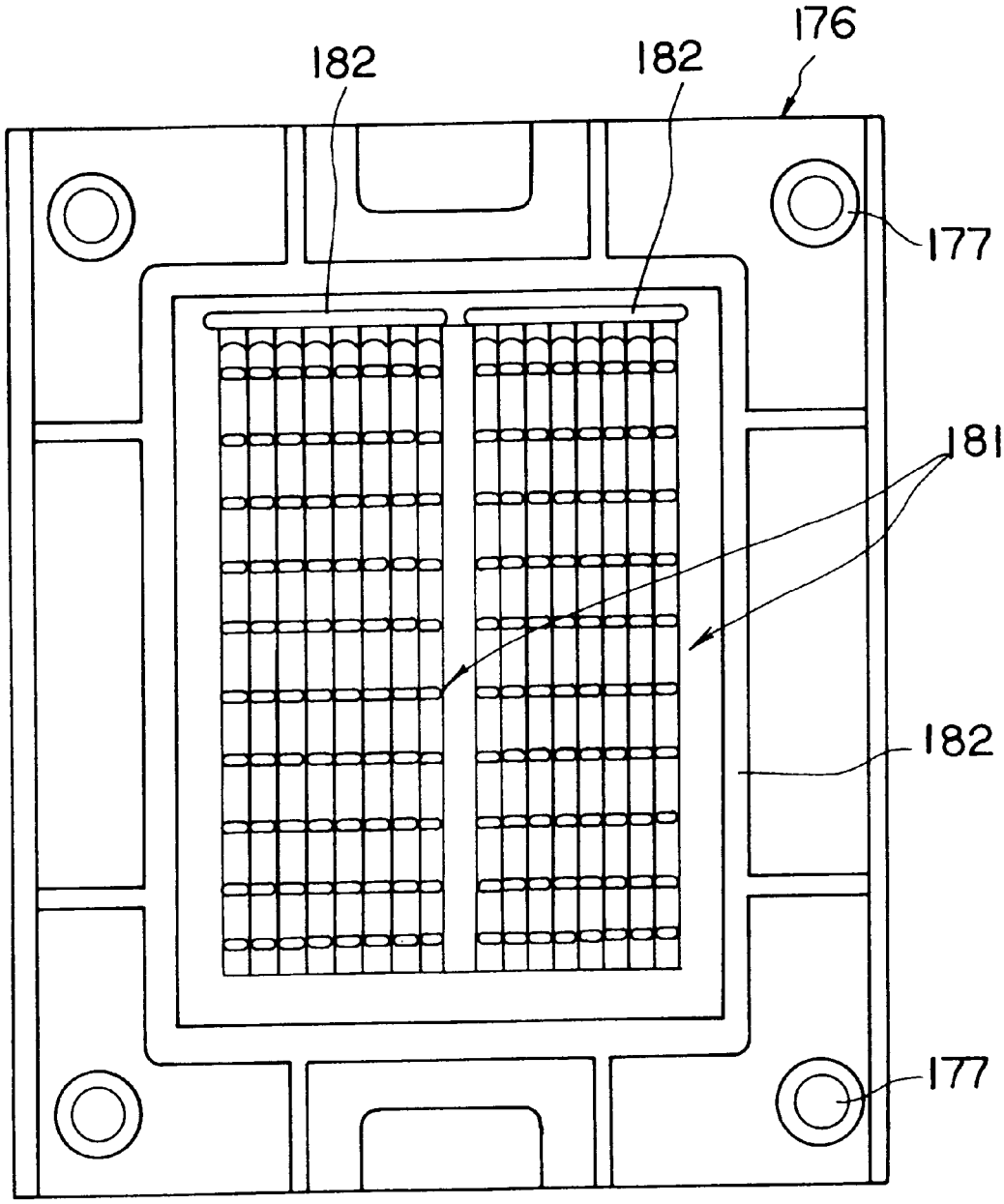
FIG. 29 is a diagram showing the lower (or the upper) mold block of the vulcanizing press.

That is, the character wheel plate 170 is formed, as shown in FIGS. 27 to 29, by vulcanizing an unvulcanized rubber sheet by means of mold blocks 175 and 176 of a vulcanizing press. These mold blocks 175 and 176 are vertically split-type molds made of metal such as iron (carbon iron), copper alloy, aluminium or the like. Positioning guide pins 177 are planted at four corner portions of the lower mold block 175 and the positioning guide pins 177 are fitted into guide holes 178 formed to four corner portions of the upper mold block 176. The upper and lower mold blocks 175 and 176 are formed, at the central portions thereof, with processing surfaces 180 and 181 as mold formation surfaces for forming the character wheel plate 170 at the central portions thereof. A clearance groove 182 is formed to the peripheral portion of at least one of the working surfaces 180 and 181. The mold blocks 175 and 176 are heated to a temperature of 140 to 155° C., preferably 150° C. and subjected to molding by the vulcanizing press to make the character wheel plate 170 to thereby produce two sheets of character wheel plates 170 at one vulcanization molding process. In the character wheel plate 170, the flexible character wheel bands 165 are joined in parallel through the linear weakened areas 171 as shown in FIGS. 24 and 25, and the linear areas 171 are formed by setting the gap between the upper and lower mold blocks 175 and 176 to nearly zero. The vertical relationship between the upper and lower mold blocks 175 and 176 is not limited to that shown in FIGS. 25 and 26 and the vertical relationship of the mold blocks 175 and 76 may be reversed.

The manufacture of the character wheel plate 170 is implemented as set forth below.

An unvulcanized rectangular rubber sheet made of synthetic rubber, natural rubber or the like is placed on the processing surfaces of the lower mold block 176. After that, the upper and lower mold blocks 175 and 176 are registered by utilizing the guide pins 177 and pressed by the vulcanizing press. By using a hot plate or heater, the mold blocks 175 and 176 are heated to 140 to 155° C., e.g. 150° C., so as to mold and vulcanize the unvulcanized rubber sheet. When pressurizing the upper and lower mold blocks 175 and 176. During the vulcanizing and molding processes, the venting is repeatedly carried out to prevent gas or the like from being included in the character wheel plate 170 to be formed.

After the unvulcanized rubber sheet has been formed by using the upper and lower mold blocks 175 and 176 and by the vulcanizing press, the upper and lower mold blocks 175 and 176 are released, and the vulcanized and formed plate is removed from the mold blocks 175 and 176. The peripheral portion of the plate removed from the mold blocks 175 and 176 is torn off to finish the rectangular character wheel plate 170 shown in FIGS. 22 and 23.

The character wheel plate 170 shown in FIGS. 22 and 27 can be easily torn out by hand along the weakened linear areas 171. Through this tearing-out step, the rubber character wheel ring 129, which is the endless flexible character wheel ring, is formed. This means that no cutting device such as a cutter is required in making the character wheel rings 129, and the belt-shaped rubber character wheel rings 129 can be easily obtained by tearing the character wheel plate 170 at the weakened areas 171. The character wheels 127 can be easily manufactured by mounting the character wheel rings 129 to the outer peripheries of the character wheel discs 128.

Since the character wheel rings 129 are made of rubber, they exhibit good affinity for ink, and ink can be uniformly applied on the desired type surfaces of the type elements on the character wheel rings 129. Hence, using the rubber character wheel rings 129 with the character wheels 127 permits sharp, clear, clean printing to be accomplished.

It is to be noted that the present invention is not limited to the described embodiments and their preferred ones and many other changes and modifications may be made without departing from the scopes of the appended claims.

What is claimed is:

1. A character wheel for a numbering machine comprising:

a character wheel disc having a polygonal shape and including a plurality of printing portion mounting surfaces formed at an equal interval from each other in a circumferential direction on an outer peripheral surface of the character wheel disc and an engaging groove formed to at least one of intermediate portions between two adjacent printing portion mounting surfaces; and a flexible character wheel band mounted to the outer peripheral surface of the character wheel disc and having a plurality of printing portions corresponding to the printing portion mounting surfaces of the character wheel disc when mounted, said character wheel band having engaging projections formed at both longitudinal ends thereof, said engaging projections being engaged with the engaging groove formed to the character wheel disc so that the flexible character wheel band is mounted to the character wheel disc therearound.

2. A character wheel according to claim 1, wherein said character wheel disc further has guide grooves formed to the printing portion mounting surfaces, respectively, for positioning the character wheel band on the character wheel disc, and said character wheel band has engaging elements formed to a surface thereof on a side facing the character wheel disc so that said engaging elements are engaged with the guide grooves formed to the character wheel disc.

3. A character wheel according to claim 2, wherein each of said guide grooves has a rectangular shape in section and each of said engaging elements has a rectangular shape in section engageable with said guide groove.

4. A character wheel according to claim 1, wherein said flexible character wheel band is formed of rubber and composed of printing portions on which numerals, like are formed and connection portions connecting the respective printing portions so as to provide an integral band shape.

5. A character wheel according to claim 1, wherein said character wheel disc is formed with, at a central portion thereof, a shaft inserting hole through which a character wheel shaft is inserted and a feed ratchet plate is formed on a side surface of the character wheel disc in an integral manner.

6. A character wheel according to claim 1, wherein said character wheel disc has a decagonal shape.

7. A method of manufacturing a character wheel of a numbering machine comprising the steps of:

preparing a polygonal character wheel disc, through a molding process, having a plurality of printing portion mounting surfaces formed at an equal interval from each other in a circumferential direction on an outer peripheral surface of the character wheel disc and an engaging groove formed to at least one of portions between two adjacent printing portion mounting surfaces, and also preparing, through a vulcanization process, a flexible character wheel band having engaging projections formed to both longitudinal ends thereof and having a plurality of printing portions; and mounting said character wheel band to said character wheel disc such that the engaging projections formed at both longitudinal ends thereof are engaged with said engaging groove formed to the character wheel disc so that the flexible character wheel band is mounted to the character wheel disc such that the printing portions of the character wheel band correspond respectively to the printing portion mounting surfaces of the polygonal character wheel disc.

8. A character wheel manufacturing method according to claim 7 wherein said flexible character wheel band is formed of rubber material including natural rubber or synthetic rubber.

9. A character wheel manufacturing method according to claim 7, wherein said character wheel disc is formed so as to be further provided with guide grooves formed to the printing portion mounting surfaces, respectively, for positioning the character wheel band on the character wheel disc and said character wheel band is formed so as to be provided with engaging elements formed to a surface thereof on a side facing the character wheel disc so that said engaging elements are engaged with the guide grooves formed to the character wheel disc.

10. A character wheel manufacturing method according to claim 7, wherein said character wheel disc is formed with, at a central portion thereof, a shaft inserting hole through which a character wheel shaft is inserted and a feed ratchet plate is formed on a side surface of the character wheel disc in an integral manner.

* * * * *